US006715409B2

(12) United States Patent
Brewer et al.

(10) Patent No.: US 6,715,409 B2
(45) Date of Patent: Apr. 6, 2004

(54) METHOD AND APPARATUS FOR ELIMINATING FREE CLEARANCES IN A PRESS SHUTHEIGHT ADJUSTMENT MECHANISM

(75) Inventors: W. Craig Brewer, Minster, OH (US); Bradley Burns, Wapakoneta, OH (US); Robert Schockman, St. Henry, OH (US); Bryan Pax, Minster, OH (US); Donald Bornhorst, Minster, OH (US)

(73) Assignee: The Minster Machine Company, Minster, OH (US)

( * ) Notice: Subject to any disclaimer, the term of this patent is extended or adjusted under 35 U.S.C. 154(b) by 0 days.

(21) Appl. No.: 10/154,211

(22) Filed: May 22, 2002

(65) Prior Publication Data

US 2003/0217651 A1 Nov. 27, 2003

(51) Int. Cl.[7] ..... B30B 5/00

(52) U.S. Cl. ..... 100/35; 100/257; 100/299; 72/448; 83/530

(58) Field of Search ..... 100/35, 42, 48, 100/257, 282, 299; 72/446, 448, 455; 74/583, 586, 603; 83/527, 530

(56) References Cited

U.S. PATENT DOCUMENTS 3,662,640 A 5/1972 Wrona
4,150,618 A * 4/1979 Spanke et al. ..... 100/257
4,166,415 A 9/1979 Spanke et al.
4,289,066 A 9/1981 Proga
4,823,687 A * 4/1989 Yonezawa et al. ..... 100/346
5,349,902 A 9/1994 Daniel et al.
5,493,959 A * 2/1996 Yagi et al. ..... 100/43
5,682,813 A 11/1997 Brewer et al.
5,761,971 A 6/1998 Brewer et al.
5,791,240 A 8/1998 Yagi et al.
6,267,050 B1 * 7/2001 Brewer ..... 100/257

* cited by examiner

*Primary Examiner*—Allen Ostrager
*Assistant Examiner*—Jimmy Nguyen
(74) *Attorney, Agent, or Firm*—Randall J. Knuth

(57) ABSTRACT

An apparatus for use in a press machine eliminates the free clearances present between the threaded portions of a screw and adjustment nut assembled in a shutheight adjustment mechanism. A hydraulic assembly directs a pressurized fluid against an outer periphery of the adjustment nut to effectively compress the adjustment nut and cause its threaded portion to be displaced into interlocking engagement with the threaded portion of the screw. Alternatively, the hydraulic assembly may be arranged to hydraulically pressurize an interior space of the screw to effectively expand the screw and cause its threaded portion to be displaced into interlocking engagement with the threaded portion of the adjustment nut.

34 Claims, 12 Drawing Sheets

METHOD AND APPARATUS FOR ELIMINATING FREE CLEARANCES IN A PRESS SHUTHEIGHT ADJUSTMENT MECHANISM

BACKGROUND OF THE INVENTION

1. Field of the Invention

The present invention relates to a shutheight adjustment mechanism for use in press machines, and, more particularly, to a method and apparatus for modifying the spatial relationship between the parts of the shutheight adjustment mechanism such as the threaded nut and screw members by inducing a deformation activity therein which is sufficient to displace the threaded portions into an interlocking engagement that eliminates the free clearances therebetween.

2. Description of the Related Art

Mechanical presses of the type performing stamping and drawing operations employ a conventional construction including a frame having a crown and bed portion and a slide supported within the frame for reciprocating movement toward and away from the bed. The slide is driven by a crankshaft having a connecting arm coupled to the slide. These mechanical presses are widely used for a variety of workpiece operations employing a diverse array of die sets, with the press machine varying substantially in size and available tonnage depending upon its intended use. The availability of a diverse selection of die sets for installation into the press machines requires an adjustment capability that tailors the shutheight dimension to the particular configuration of press machine and die assembly.

One conventional press arrangement employs a slide configured for connection to the crankshaft by a connecting rod that is adjustable in length or which is connected to another device such as a connection screw that is adjustable in its spatial separation from the slide, thereby permitting adjustments to be made to the shutheight dimension in order to accommodate various die sets. Adjustment mechanisms of the type employing an adjustable connecting rod or connection screw have typically been arranged such that the individual working parts are disposed within the slide, requiring that any shutheight adjustments be made only through changes in the position of the slide relative to the bed. Alternatively, the bed portion or bolster assembly of the press may have its position adjusted relative to the slide so as to adjust the shutheight therebetween. Regardless of the mode of shutheight adjustment, the slide is generally guided on the uprights of the press frame extending between the crown and bed so that the parts of the die set remain in accurate registration as the slide reciprocates.

One conventional adjustment mechanism employs a plurality of connection screw assemblies configured within the slide and actuated simultaneously by means of a worm-gear arrangement, which is driven either manually or by means of an operator controlled motor. This arrangement effectuates a change in the shutheight by changing the position of the slide relative to each of the connection screws. As known, the manufacture and assembly of any form of shutheight adjustment mechanism requires the development of various spatial clearances between the discrete parts of the mechanism. Additionally, it is necessary to implement various working tolerances between the connected portions of the press, specifically the connections that couple the shutheight adjustment mechanism to the slide or bolster. Proper formation of these clearances and tolerances allows the worm gear, adjustment nuts, and connection screws, for example, to be rotated and otherwise moved so that the adjustment mechanism may be suitably operated.

However, the existence of such clearances and tolerances present various difficulties in accurately controlling press shutheight and in reproducing a constant bottom-dead-center operating range since the clearances permit small but adverse displacements of the adjustment mechanism parts and the attached slide or bolster beyond their normal operating range under certain load conditions. Current problems with shutheight adjustment mechanisms include the transfer of punching and snap through loads through the adjustment mechanism during press operation. A press load is the load created by the mechanical press when the slide is urging its associated die member into contact with the workpiece. When the workpiece fractures in the die, the slide attempts to rapidly accelerate downward, which corresponds to the snap through action. This snap through load is comprised mainly of the downward acceleration and the downward slide crank inertial acceleration of the die and slide combination. The failure to implement measures aimed at counteracting such snap through loads or retarding such snap through action may cause an unwanted change in the shutheight and lead to excessive die penetration beyond its normal operating range.

The clearances also prevent the uniform transmission of pressure loads throughout the press machine since certain force components may be communicated more or less extensively within the machine relative to other force components depending upon the degree that the force-transmitting parts shift within the clearances. This uneven distribution of forces may cause particular parts to experience concentrated impact forces leading to breakdown or failure. Again, the clearances between the parts permit the shutheight to variably change during operation of the press, resulting in workpieces that may not meet design specifications.

SUMMARY OF THE INVENTION

According to the present invention there is provided a method and apparatus for substantially eliminating the free clearances present within shutheight adjustment mechanisms that are configured for use in press machines. One illustrative arrangement of the shutheight adjustment mechanism includes a male threaded member provided in the form of a screw that threadedly engages a female threaded member provided in the form of an adjustment nut disposed about the screw. Relative rotation between the screw and adjustment nut effectuates a change in the shutheight. A clearance space is defined between respective threaded portions of the screw and adjustment nut to enable actuation of the shutheight adjustment mechanism, e.g., rotation of the adjustment nut relative to the screw.

An apparatus is provided according to the present invention to induce a deformation activity in at least one of the screw and adjustment nut that is sufficient to enable these parts to be brought into substantial interlocking engagement with one another at their respective threaded portions. This locking condition is particularly characterized by the substantial elimination of the original free clearances existing between the threaded portions of the screw and adjustment nut, thereby preventing relative rotation between the parts and effectively opposing any occurrence of snap through or other causes of excessive die penetration. This interlocking engagement is produced in one embodiment by a hydraulic assembly that directs a pressurized fluid against an outer periphery of the adjustment nut to effectively exert a compressive action upon the adjustment nut that radially displaces the threaded portion thereof into locked engagement with the threaded portion of the screw. The deformation activity in the adjustment nut may be sufficiently ordered to induce further an accompanying elongation thereof along its axial dimension to close out any clearance spaces formed adjacent the axial end surfaces of the adjustment nut. In another embodiment, a hydraulic assembly is arranged to hydraulically pressurize an interior space of the screw to effectively exert an expansive action upon the screw that radially displaces the threaded portion thereof into locked engagement with the threaded portion of the adjustment nut. The induced deformation activity present in both the screw and adjustment nut is preferably reversible and remains intact by maintaining the holding pressure upon the affected part until it is desired to restore the shutheight adjustment mechanism to an actuatable condition.

The invention, in one form thereof, comprises a press machine having a frame structure with a crown and a bed; a slide guided by the frame structure for operative reciprocating movement in opposed relation to the bed; a drive assembly attached to the frame structure for operatively reciprocating the slide; a bolster assembly mounted to the bed; and a shutheight adjustment mechanism configured within the press machine and arranged to controllably adjust the press shutheight between the slide and the bed. The shutheight adjustment mechanism includes a male threaded member threadedly engaging a female threaded member wherein at least one of the threaded members is rotatable relative to the other of the threaded members to change the press shutheight. The shutheight adjustment mechanism includes at least one clearance space defined between respective threaded portions of the male threaded member and the female threaded member. The press machine further comprises a means for inducing a deformation activity in at least one of the male threaded member and the female threaded member in a manner sufficient to effectuate a substantial interlocking engagement between the respective threaded portions of the male threaded member and the female threaded member. The male threaded member preferably includes a screw, while the female threaded member preferably includes an adjustment nut disposed about the screw. The interlocking engagement between the nut and screw is preferably characterized by a substantial elimination of the free clearance spaces otherwise associated with the threaded portions thereof.

The means for inducing such deformation activity further includes a hydraulic assembly arranged to compress the female threaded member by applying pressurized fluid along a periphery thereof and/or expand the male threaded member by hydraulically pressurizing an interior space thereof. The deformation activity generated in the female threaded member is preferably sufficient to further induce an accompanying elongation of the female threaded member along an axial dimension thereof which is sufficient to substantially close out at least one clearance space defined adjacent a respective axial end surface of the female threaded member.

The hydraulic assembly is arranged further to selectively direct pressurized fluid against one axial end surface of the female threaded member to effectively displace another axial end surface of the female threaded member in a manner sufficient to substantially close out a clearance space defined adjacent the another axial end surface.

The shutheight adjustment mechanism is attached to a one of the slide and the bolster assembly. Additionally, the shutheight adjustment mechanism may be arranged further to enable an adjustment-in-motion operability.

The drive assembly of the press machine further includes, in one illustrative combination thereof, a crankshaft; a plurality of connection assemblies each arranged to couple the crankshaft to the slide, wherein each one of the connection assemblies respectively includes a wrist pin and an associated connecting rod pivatingly connected to the wrist pin and defining therewith at least one clearance space therebetween; and a second means for inducing a deformation activity in at least one of the wrist pins which is sufficient to displace an outer periphery of the at least one wrist pin to substantially close out at least one of the at least one clearance space associated therewith.

The second means for inducing a deformation activity further comprises a hydraulic assembly arranged to hydraulically pressurize an interior space of the at least one wrist pin to effectuate the respective deformation activity therein.

The invention, in another form thereof, comprises a press machine including, in combination, a frame structure with a crown and a bed; a slide guided by the frame structure for operative reciprocating movement in opposed relation to the bed; a drive assembly attached to the frame structure for operatively reciprocating the slide; a bolster assembly mounted to the bed; and a shutheight adjustment mechanism configured within the press machine and arranged to controllably adjust the press shutheight between the slide and the bed. The shutheight adjustment mechanism comprises a male threaded member threadedly engaging a female threaded member wherein at least one of the threaded members is rotatable relative to the other of the threaded members to thereby change the press shutheight. The shutheight adjustment mechanism operatively includes at least one clearance space defined between respective threaded portions of the male threaded member and the female threaded member. The press machine further comprises a hydraulic assembly arranged to operatively perform at least one of (i) compressing at least in part the female threaded member by applying pressurized fluid along a periphery thereof in a manner sufficient to bring the respective threaded portion thereof into interlocking engagement with the male threaded member at the respective threaded portion thereof, and (ii) expanding at least in part the male threaded member by hydraulically pressurizing an interior space thereof in a manner sufficient to bring the respective threaded portion thereof into interlocking engagement with the female threaded member at the respective threaded portion thereof.

The compression of the female threaded member is associated with the presence of a reversible deformation activity occurring therein, while the expansion of the male threaded member is likewise associated with the presence of a reversible deformation activity occurring therein. The interlocking engagement between the male threaded member and the female threaded member is preferably characterized by a substantial elimination of a clearance space associated with respective threaded portions of the male threaded member and the female threaded member which are disposed in such interlocking engagement.

The deformation activity generated in the female threaded member is preferably sufficient to further induce an accompanying elongation of the female threaded member along an axial dimension thereof which is sufficient to substantially close out at least one axial clearance space defined adjacent a respective axial end surface of the female threaded member.

The hydraulic assembly is arranged further to selectively direct pressurized fluid against one axial end surface of the female threaded member to effectively displace another axial end surface of the female threaded member in a manner sufficient to substantially close out an axial clearance space defined adjacent the another axial end surface.

The invention, in another form thereof, comprises a press machine comprising, in combination, a frame structure with a crown and a bed; a slide guided by the frame structure for operative reciprocating movement in opposed relation to the bed; a drive assembly attached to the frame structure for operatively reciprocating the slide; a bolster assembly mounted to the bed; and a shutheight adjustment mechanism configured within the press machine and arranged to controllably adjust the press shutheight between the slide and the bed. The shutheight adjustment mechanism comprises a male threaded member threadedly engaging a female threaded member wherein at least one of the threaded members is rotatable relative to the other of the threaded members to thereby change the press shutheight. The shutheight adjustment mechanism operatively includes at least one clearance space defined between respective threaded portions of the male threaded member and the female threaded member. The press machine further comprises an actuating assembly operatively associated with the shutheight adjustment mechanism and arranged to effectuate a substantial interlocking engagement between the respective threaded portions of the male threaded member and the female threaded member by (i) compressing at least in part the female threaded member and/or (ii) expanding at least in part the male threaded member.

The actuating assembly further includes a hydraulic assembly that is arranged to (i) apply a pressurized fluid along a periphery of the female threaded member to exert a compressive influence thereon and/or (ii) hydraulically pressurize an interior space formed in the male threaded member to exert an expansive influence thereon. The interlocking engagement between the male threaded member and the female threaded member is preferably characterized by a substantial elimination of a clearance space associated with respective threaded portions of the male threaded member and the female threaded member which are disposed in such interlocking engagement. The male threaded member preferably includes a screw, while the female threaded member preferably includes an adjustment nut disposed about the screw. Additionally, the shutheight adjustment mechanism is attached to a one of the slide and the bolster assembly.

The compression of the female threaded member is preferably sufficient to further induce an accompanying elongation of the female threaded member along an axial dimension thereof which is sufficient to substantially close out at least one clearance space defined adjacent a respective axial end surface of the female threaded member.

The invention, in another form thereof, comprises a method of adjusting the shutheight in a press machine, wherein such press machine comprises a frame structure with a crown and a bed, a slide guided by the frame structure for operative reciprocating movement in opposed relation to the bed, a drive assembly attached to the frame structure for operatively reciprocating the slide, and a bolster assembly mounted to the bed. In accordance with such shutheight adjustment method, there is provided a shutheight adjustment mechanism configured within the press machine and arranged to controllably adjust the press shutheight between the slide and the bed. The shutheight adjustment mechanism comprises a male threaded member threadedly engaging a female threaded member, wherein at least one of the threaded members is rotatable relative to the other of the threaded members to thereby change the press shutheight. The shutheight adjustment mechanism operatively includes at least one clearance space defined between respective threaded portions of the male threaded member and the female threaded member.

When a locking mode is desired for the shutheight adjustment mechanism, a deformation activity is induced in at least one of the male threaded member and the female threaded member in a manner sufficient to effectuate a substantial interlocking engagement between the respective threaded portions of the male threaded member and the female threaded member. This inducement of the deformation activity is associated with a holding influence acting upon the affected threaded member that is effective in adjustably continuously maintaining the interlocking engagement.

When an adjustment mode is desired for the shutheight adjustment mechanism and the locking mode has been enabled, the holding influence is first reduced to a level sufficient to accommodate operative rotational activity between the male threaded member and the female threaded member. Next, the shutheight adjustment mechanism may be actuated to controllably change the shutheight. The holding influence is preferably restored to a level sufficient to effectuate and thereby reinstate the locking mode. When an adjustment mode is desired for the shutheight adjustment mechanism and the locking mode is not in use, the shutheight adjustment mechanism is actuated in a conventional manner to controllably change the shutheight.

Inducing a deformation activity in at least one of the male threaded member and the female threaded member respectively comprises the steps of (a) directing pressurized fluid against an outer periphery of the female threaded member to generate deformation activity therein, and (b) hydraulically pressurizing an interior space of the male threaded member to generate deformation activity therein. Accordingly, a reduction in the holding influence may be accomplished respectively by (a) reducing the pressurization level of fluid directed against the outer periphery of the female threaded member, and (b) reducing the hydraulic pressurization level within the interior space of the male threaded member.

The interlocking engagement between the male threaded member and the female threaded member is preferably characterized by a substantial elimination of a clearance space associated with respective threaded portions of the male threaded member and the female threaded member which are disposed in such interlocking engagement.

The present invention, in yet another form thereof, comprises a method of adjusting the shutheight in a press machine having a frame structure with a crown and a bed, a slide guided by the frame structure for operative reciprocating movement in opposed relation to the bed, a drive assembly attached to the frame structure for operatively reciprocating the slide, and a bolster assembly mounted to the bed. In accordance with such shutheight adjustment method, there is first provided a shutheight adjustment mechanism configured within the press machine and arranged to controllably adjust the press shutheight between the slide and the bed. The shutheight adjustment mechanism comprises a male threaded member threadedly engaging a female threaded member, wherein at least one of the threaded members is rotatable relative to the other of the threaded members to thereby change the press shutheight. The shutheight adjustment mechanism operatively includes at least one free clearance space defined between respective threaded portions of the male threaded member and the female threaded member.

When a locking mode is desired for the shutheight adjustment mechanism, a substantial interlocking engagement is effectuated between the respective threaded portions of the male threaded member and the female threaded member by (i) compressing at least in part the female threaded member and/or (ii) expanding at least in part the male threaded member. When an adjustment mode is desired for the shutheight adjustment mechanism and such locking mode has been enabled, there is performed a reduction in at least one of (i) the compression of the female threaded member and (ii) the expansion of the male threaded member, to a level sufficient to accommodate actuation of the shutheight adjustment mechanism. After "unlocking" the shutheight adjustment mechanism, the relevant parts are actuated to controllably change the shutheight. It is then preferable to restore at least one of (i) the compression of the female threaded member and (ii) the expansion of the male threaded member, to a level sufficient to effectuate and thereby reinstate the locking mode. When an adjustment mode is desired for the shutheight adjustment mechanism and the locking mode has not been engaged, the shutheight is simply changed by actuating the shutheight adjustment mechanism in a conventional manner.

In accordance with a preferred implementation of the shutheight adjustment method, the compression of the female threaded member includes directing a pressurized fluid against an outer periphery thereof, while the expansion of the male threaded member includes hydraulically pressurizing an interior space formed therein. The interlocking engagement between the male threaded member and the female threaded member is preferably characterized by a substantial elimination of a clearance space associated with respective threaded portions of the male threaded member and the female threaded member which are disposed in such interlocking engagement.

One advantage of the present invention is that the individual parts of the shutheight adjustment mechanism may be selectively locked together when the mechanism is otherwise not actuated, thereby eliminating during the pendency of this locking state the free clearances that pose problems of die penetration for the press machine.

Another advantage of the present invention is that the shutheight adjustment mechanism may be variably operated in a selected one of a locking condition, an adjustment condition, and a damping condition (i.e., the free clearances are filled with fluid to form a load-supporting pressure squeeze-film) depending upon the current operating environment, load characteristics, and other working parameters.

A further advantage of the present invention is that by controllably eliminating the free clearances located at the threaded portions of the adjustment nut and screw, at the axial end surfaces of the adjustment nut, and between the wrist pin and connecting rod of the slide connection assembly, it is now possible to reduce the snap through effect and thereby eliminate or greatly diminish the die penetration problem.

A further advantage of the present invention is that the functionality of eliminating the free clearances by compressing the adjustment nut and/or expanding the screw is compatible with, and may be seamlessly incorporated into, any of various shutheight adjustment mechanisms having operational features such as adjustment-in-motion and a quick-access hydraulic pressurization apparatus.

A yet further advantage of the present invention is that the bottom-dead-center level associated with the slide operating range is reliably reproducible and repeatable.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein:

FIG. 6 is a view similar to FIG. 4 additionally illustrating the application of an axially-directed pressurizing force to displace an opposing axial end surface of the nut member, according to another aspect of the present invention;

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
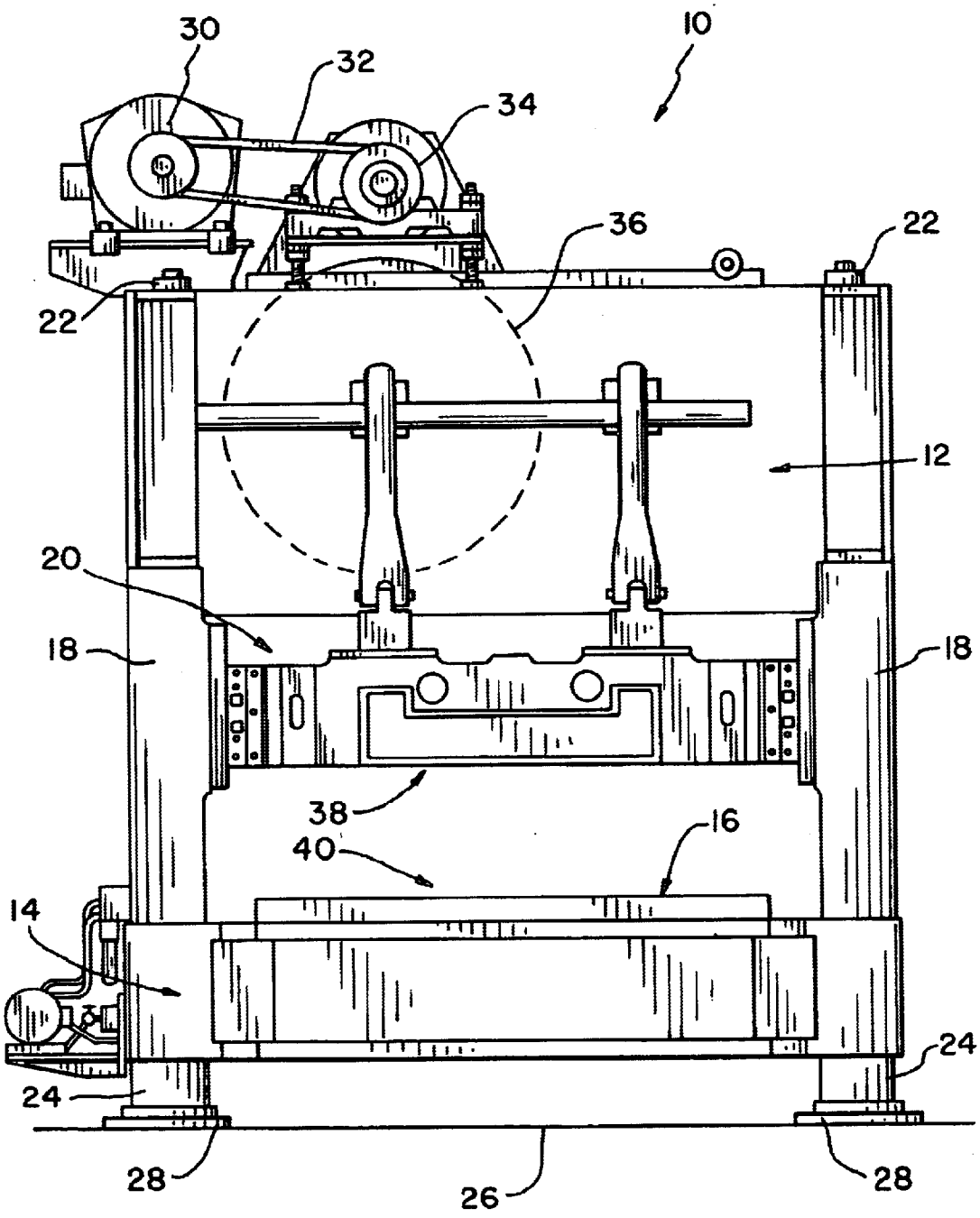
FIG. 1 is a front elevational view of a press machine in one illustrative form thereof incorporating the shutheight adjustment mechanism of the present invention.

The shutheight adjustment mechanisms shown and described herein and adapted in accordance with the present invention may be installed within machines of the mechanical press type. Accordingly, reference is first made by way of background to FIG. 1, in which there is shown a mechanical press 10 of conventional form including a crown portion 12, a bed portion 14 having a bolster assembly 16 connected thereto, and uprights 18 connecting crown portion 12 with bed portion 14. Uprights 18 are connected to or integral with the underside of crown 12 and the upper side of bed 14. A slide 20 is positioned between uprights 18 for controlled reciprocating movement between crown 12 and bed 14. Tie rods (not shown) extending through crown 12, uprights 18 and bed portion 14 are attached at each end with tie rod nuts 22. Leg members 24 are formed as an extension of bed 14 and are generally mounted on shop floor 26 by means of shock absorbing pads 28. A drive press motor 30, which is part of the drive mechanism, is attached by means of a belt 32 to an sheave 34 attached to crown 12. Sheave 34 is connected by means of a belt (not shown) to the main flywheel of the combination clutch/brake assembly, depicted generally at 36. This form of the press machine is described for illustrative purposes only as it should be apparent to those skilled in the art that the principles of the present invention may be practiced with and incorporated into other machine configurations. Press machine 10, when fully configured with a die assembly installed therein, further includes an upper die (not shown) generally located at area 38 and attached by known means in a conventional manner to the lower end of slide 20. A lower die (not shown) located generally at area 40 is attached by known means in a conventional manner to the upper end of bolster 16. The upper and lower dies, as so arranged in their opposing spaced-apart relationship, cooperate in a known manner during press operation to process a workpiece disposed therebetween, e.g., fastened to the lower die. The upper and lower dies together constitute a die set or assembly.

Figure 2:
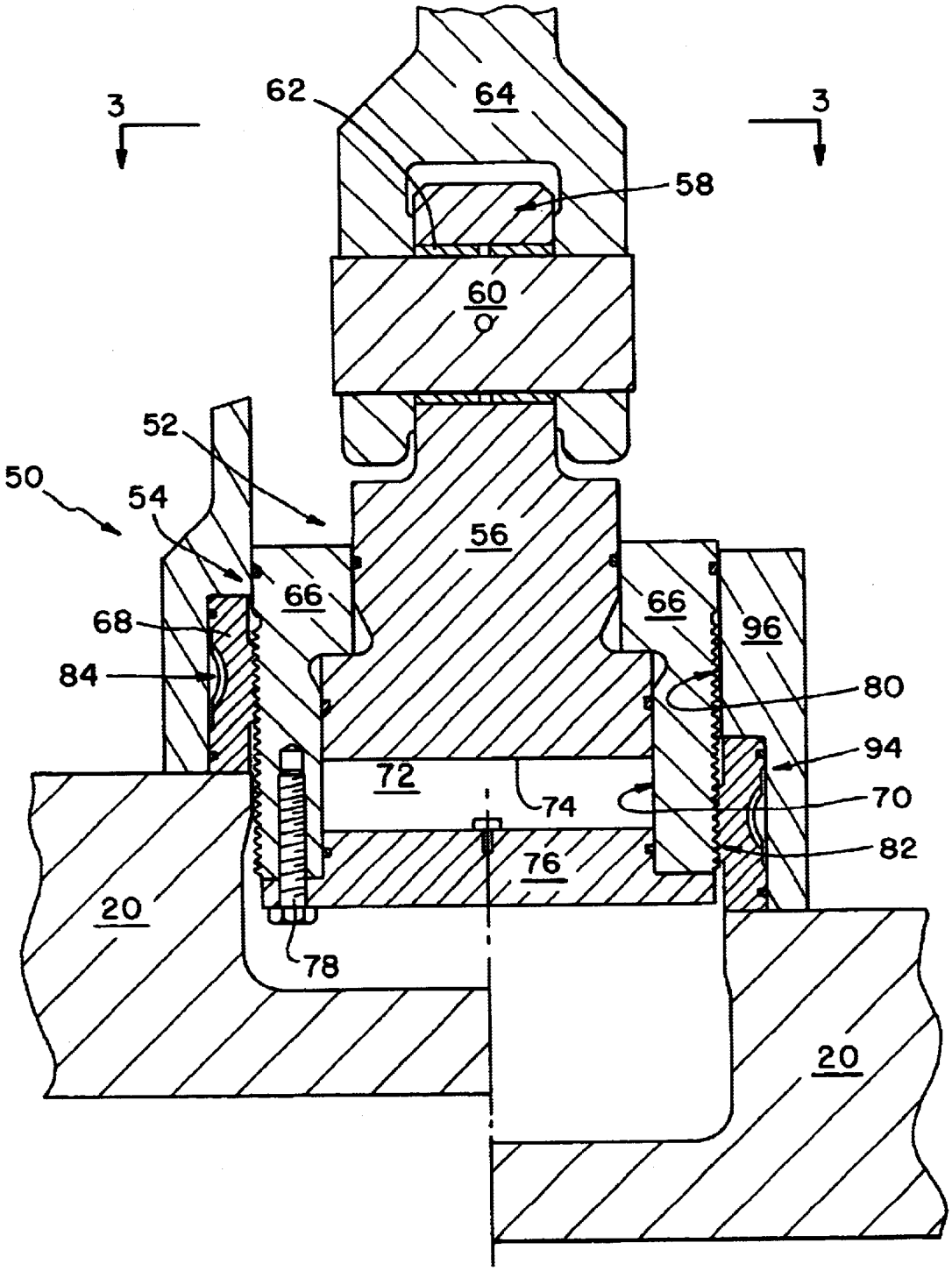
FIG. 2 is an enlarged partial cross-sectional view of one illustrative type of shutheight adjustment mechanism adapted in accordance with one embodiment of the present invention.
Figure 7:
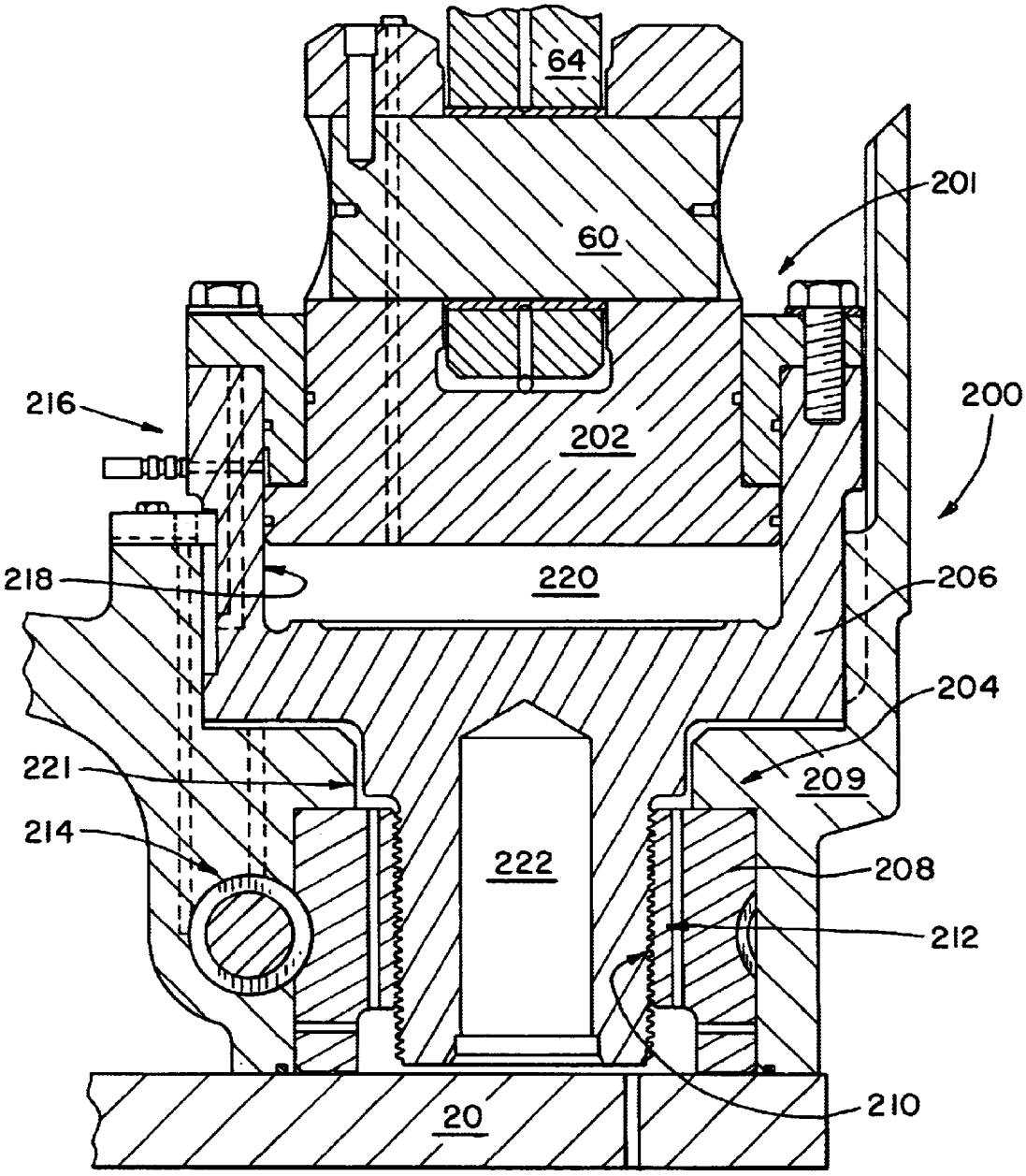
FIG. 7 is an enlarged partial cross-sectional view of another illustrative type of shutheight adjustment mechanism adapted in accordance with another embodiment of the present invention.
Figure 8:
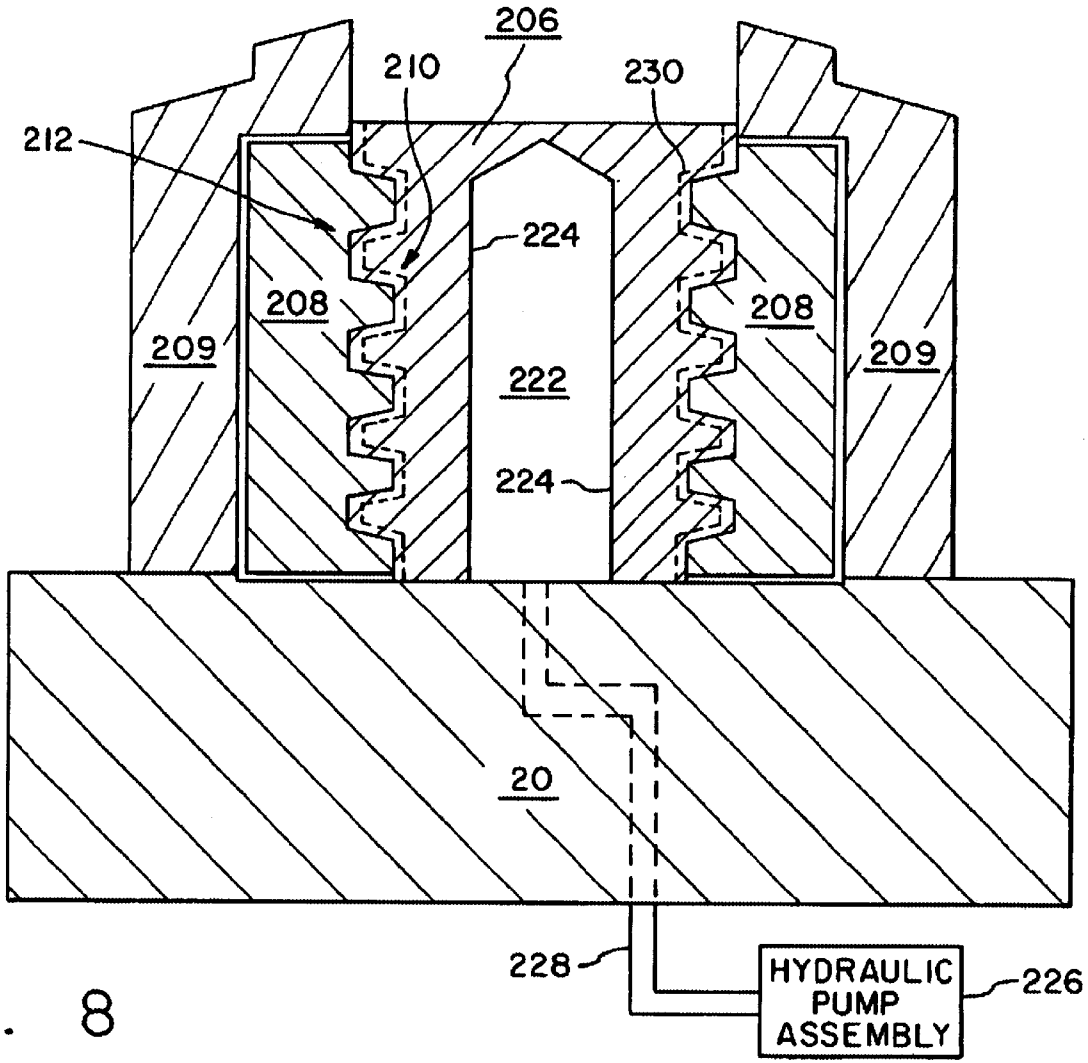
FIG. 8 is an exaggerated fragmentary cross-sectional view of the nut-screw combination for the shutheight adjustment mechanism shown in FIG. 7 to illustrate a locking condition established in accordance with another embodiment of the present invention.

Referring now to the drawings, and particularly to FIG. 2, there is shown in sectional plan view one illustrative type of shutheight adjustment mechanism 50 incorporating the variably controllable locking facility according to the present invention. As will become more apparent herein, this particular device arrangement disclosed in FIG. 2 is provided for illustrative purposes only and should not be considered in limitation of the present invention herein. Rather, it should be understood that the present invention may be integrated into various other shutheight adjustment mechanisms. By way of overview, FIGS. 2–6 relate to one illustrative implementation of the locking facility according to one embodiment of the present invention in which shutheight adjustment mechanism 50 is adapted to enable compression of the adjustment nut and thereby effectuate a closeout of the clearance space defined between the respective threaded portions of the adjustment nut and connection screw. FIGS. 7–8 relate to another illustrative implementation of the locking facility according to another embodiment of the present invention in which another illustrative type of shutheight adjustment mechanism incorporating the variably controllable locking facility of the present invention is adapted to enable expansion of the connection screw and thereby effectuate a close-out of the clearance space defined between the respective threaded portions of the adjustment nut and connection screw.

The present invention broadly relates to a locking facility that acts to lock together various cooperating parts of an assembly or device arrangement in order to inhibit relative movement therebetween particularly during operation of the host machine in which the cooperating parts are installed. This inhibited movement would otherwise represent, for example, the operative working motion of the parts corresponding to their actuation in a non-locked condition. Additionally, such movement may relate to the displacement of parts through clearances and other tolerances required for assembly of the parts. For example, when the principles of the present invention are adapted for use in a shutheight adjustment mechanism employing a female threaded member and a male threaded member (e.g., an adjustment nut and connection screw, respectively) that are provided in threaded intermeshing engagement having a clearance space therebetween, proper actuation of the locking facility to configure these parts into a state of locked engagement will prevent relative rotation therebetween by closing-out the clearance space between the threaded portions. For purposes herein, references to a "male threaded member" and a "female threaded member" should be understood as encompassing any arrangement of threaded parts having complementary threaded portions enabling intermeshing engagement therebetween. For example, the threaded parts may include an annular nut disposed about an annular screw or an annular nut disposed about a cylindrical solid body screw.

In accordance with the present invention, the locking condition for such an arrangement of parts involves inducing, generating, or otherwise developing a deformation activity in at least one of the male threaded member and the female threaded member in a manner sufficient to effectuate a substantial interlocking engagement between the respective threaded portions of the threaded members. This interlocking engagement between the threaded portions of the male and female threaded members is characterized by a substantial elimination of the clearance space that is associated with the respective threaded portions of the threaded members that are disposed in such interlocking engagement. In a preferred form, this deformation activity may be understood as encompassing a compression of the adjustment nut and an expansion of the connection screw. In particular, the compression activity produces a radially inward displacement of the inner-facing threaded surface of the adjustment nut, while the expansion activity produces a radially outward displacement of the outer-facing threaded surface of the connection screw.

This locking condition is preferably implemented in conjunction with a hydraulic assembly that is arranged to compress the adjustment nut by applying pressurized fluid along an outer periphery thereof and/or expand the connection screw by hydraulically pressurizing an interior space thereof.

As used herein, "deformation activity" and any terms relating thereto, as applied to a part or structure subject to such activity, should be understood as encompassing the presence and/or occurrence of a change, modification, or other such reshaping-type alteration in at least one geometrical or dimensional property or characteristic of the part. For example, the deformation activity represented by a compression of the adjustment nut features a reduction in the inner diameter of the annular-shaped nut as the hydraulic compressive influence is being applied along the outer diameter peripheral surface of the nut. Reducing the nut inner diameter in this manner facilitates development of the interlocking engagement of the threaded portions of the nut and screw since the threaded portion of the adjustment nut is present at this inner diameter surface and therefore undergoes displacement in response to and in accordance with the compression activity. Additionally, the deformation activity represented by an expansion of the connection screw features an increase in the outer diameter of the cylindrical-shaped screw as the hydraulic expansive influence is being applied along an inner diameter peripheral surface of a fluid pressurizing chamber formed at an interior of the screw. Increasing the screw outer diameter in this manner facilitates development of the interlocking engagement of the threaded portions of the nut and screw since the threaded portion of the connection screw is present at this outer diameter surface and therefore undergoes displacement in response to and in accordance with the expansion activity.

With respect to implementing such interlocking engagement between the respective threaded portions of any male and female threaded members that are provided in intermeshing arrangement, it should be understood that such deformation activity is properly ordered towards effecting a displacement of the threaded portion of at least one of the threaded members to bring it into interlocking engagement with the facing threaded portion of the other threaded member. This interlocking engagement may be understood as substantially establishing a surface-to-surface (i.e., metal-to-metal) interference-type contacting engagement between the various surfaces of interlocked teeth. In particular, the upper and lower flank surfaces of each tooth projection will be placed respectively in surface-abutting contact with the lower flank surface and upper flank surface of respective adjacent teeth interlocked therewith. Of course it should be noted that full interlocking will also involve surface-to-surface abutting contact between the outermost face of the tooth projection and the complementary indent surface that separates adjacent teeth.

It should be understood that this metal-to-metal interference is necessarily associated with an elimination of the free clearances between the contacting surfaces, which effectively locks the parts together to inhibit and/or prevent relative motion (i.e., rotation) therebetween. In the absence of such clearance close-out, the vertical clearances at the upper and lower flank surfaces of the intermeshing threaded portions are responsible in part for accommodating unwanted changes in the shutheight such as when snap through occurs or during an impact cycle that involves high inertial loads. In particular, these vertical clearances permit the parts to move vertically with respect to one another through this clearance space, thereby changing the relative separation of the parts and hence the shutheight parameter. By effectively closing out these vertical clearances present at the threaded portions by bringing about the metal-to-metal interference that accompanies the interlocking engagement, the die penetration problem has been solved insofar as it relates to the existence of these free clearances during press cycling.

This deformation activity is preferably performed in a reversible manner so that the affected part can be substantially restored to its original shape and position within the mechanism, namely after the influences that induced the deformation activity are removed, i.e., by relieving the hydraulic-type compressive forces on the adjustment nut and/or the expansive influences on the connection screw. As will be discussed herein, this reversibility enables the nut-screw combination to be returned to its operative configuration for purposes of making it available for actuation. Additionally, the deformation activity is developed, sustained, and otherwise managed in a variably controllable manner to permit the shutheight adjustment mechanism to be selectively placed in an actuating mode and a locking mode.

Referring more particularly to FIG. 2, the illustrated shutheight adjustment mechanism 50 incorporating the locking facility according to one embodiment of the present invention is arranged for use in one illustrative form thereof within slide 20 of press machine 10 of FIG. 1 to operatively effect a change in the shutheight by changing the position of slide 20 relative to the bolster assembly in a conventional manner known to those skilled in the art. It should be apparent that the locking facility of the present invention may be equivalently practiced with and incorporated into shutheight adjustment mechanisms that are integrated within the bolster assembly to operatively effect a change in the shutheight by changing the position of the bolster assembly relative to slide 20 in a conventional manner known to those skilled in the art.

The illustrated shutheight adjustment mechanism 50 includes a quick-access hydraulic assembly 52 and an adjustment assembly 54 both arranged to make changes to the shutheight via corresponding actuation thereof. The illustrated quick-access hydraulic assembly 52 includes a piston element 56 with an upper arm 58 having a transverse cylindrical bore formed therethrough to axially receive a wrist pin 60. A bushing 62 is disposed about wrist pin 60 within the piston cylindrical bore. A connecting rod 64 of conventional construction is pivotally connected to wrist pin 60 to constitute a slide connection assembly that couples the drive assembly of press machine 10 (e.g., crankshaft) to slide 20 in a conventional manner. For ease of description, only the attachment of one shutheight adjustment mechanism 50 to a single such slide connection assembly is disclosed herein, although it should be understood that the present invention is not limited to presses with a specific number of connecting rods 64 and shutheight adjustment mechanisms 50; rather, the locking facility of the present invention may be incorporated into any number of such mechanisms 50 associated with any arrangement of slide connection assemblies.

The illustrated adjustment assembly 54 includes a connection screw 66 disposed at least in part about piston 56 and an adjustment nut 68 disposed at least in part about screw 66. Both connection screw 66 and adjustment nut 68 are provided in a conventional form having a construction well known to those skilled in the art. Connection screw 66 is provided in a generally annular shape and defines a generally cylindrical bore 70 within which piston 56 is disposed for reciprocating movement in response to pressurization changes within a hydraulic chamber 72 formed between an underside 74 of piston 56 and an end cap structure 76 integrally attached as shown to screw 66 by means of securing bolts 78. Connection screw 66 includes an outer surface including a threaded portion generally illustrated at 80 provided in facing opposition to adjustment nut 68, i.e., at a threaded portion thereof. Adjustment nut 68 is provided in a generally annular shape having an inner surface including a threaded portion generally illustrated at 82 provided in facing opposition to connection screw 66 at threaded portion 80 thereof. Adjustment nut 68 and connection screw 66 are provided in intermeshing engagement at the respective threaded portions 82 and 80 thereof in a conventional manner enabling relative rotation therebetween to facilitate axial displacement of one of the parts.

The illustrated shutheight adjustment mechanism 50 is arranged, in one form thereof, such that connection screw 66 is connected to connecting rod 64 while adjustment nut 68 is integrally attached to slide 20, wherein shutheight adjustment occurs by displacement of adjustment nut 68 relative to connection screw 66. This arrangement, however, should not be considered in limitation of the present invention as it should be apparent that the locking facility can be incorporated into other adjustment mechanisms configured for displacement of the connection screw relative to the adjustment nut. Adjustment nut 68 as shown is integrally configured within a recess shown illustratively at 94 formed within a housing assembly 96 provided in the form of a slide attachment piece integrally coupled to slide 20. Accordingly, as adjustment nut 68 is caused to move relative to connection screw 66, slide 20 is concurrently displaced to effect a change in the shutheight. Housing assembly 96 may alternatively be formed as an integral part of slide 20.

Figure 3:
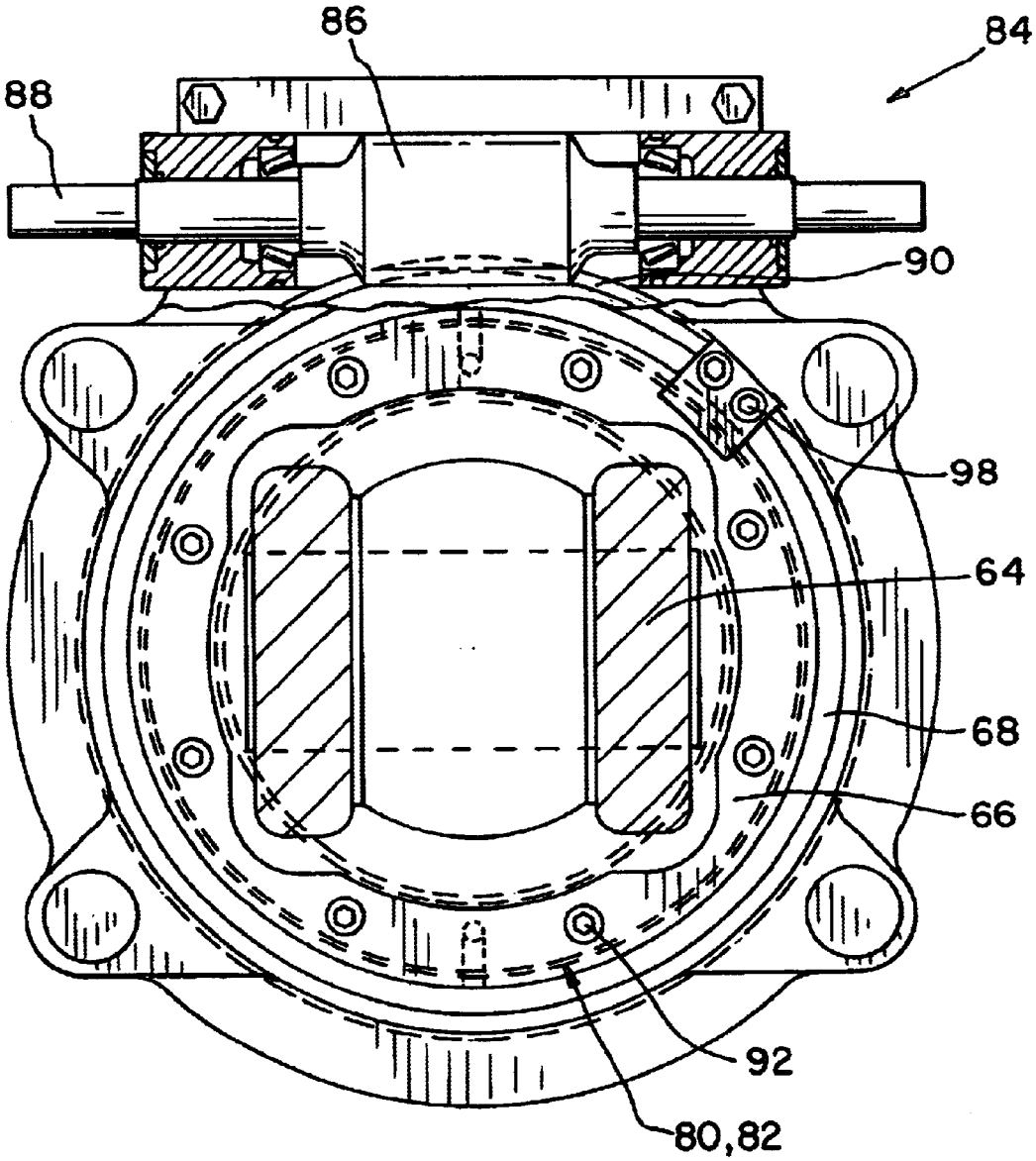
FIG. 3 is an enlarged upper plan sectional view of the shutheight adjustment mechanism shown in FIG. 2 taken along lines A—A therein.

For purposes of implementing such actuation of the combination adjustment nut 68 and connection screw 66, a drive mechanism generally illustrated at 84 and conventionally provided in the form of a worm gear arrangement is integrally configured with adjustment nut 68 to effect variable driving rotation thereof. Referring briefly to FIG. 3, which depicts an upper plan section view of shutheight adjustment mechanism 50 taken along lines A—A of FIG. 2, drive mechanism 84 includes worm 86 provided in intermeshing engagement with a worm gear 90 integrally secured to adjustment nut 68. Worm 86 is attached to a rotatable shaft 88 that is connected to a motor (not shown) for adjustment of the shutheight. It will be appreciated that as shaft 88 is rotated, worm 86 will drive adjustment nut 68 through worm gear 90 about connection screw 66 to thereby raise or lower slide 20.

Figure 4:
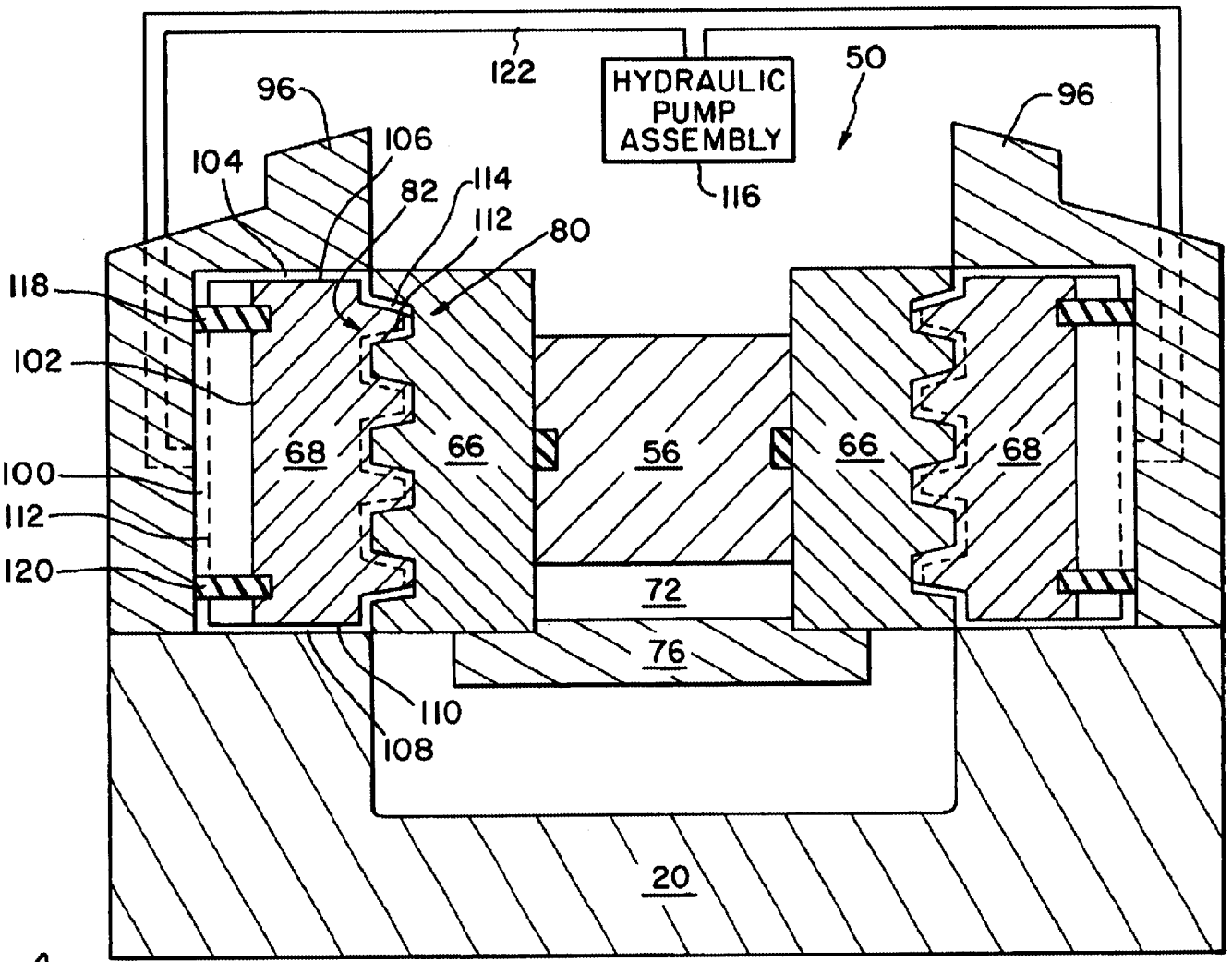
FIG. 4 is an exaggerated fragmentary cross-sectional view of the nut-screw combination for the shutheight adjustment mechanism shown in FIG. 2 to illustrate a locking condition established in accordance with one embodiment of the present invention.

Referring now to FIG. 4, there is shown a fragmented partial section view of shutheight adjustment mechanism 50 to describe the manner of placing connection screw 66 and adjustment nut 68 into the illustrated interlocking engagement by compressing adjustment nut 68 in accordance with one embodiment of the locking facility of the present invention. The relative orientation of the parts prior to interlocking engagement, and specifically the position of adjustment nut 68 before being compressed, is indicated by dashed position line 112. The working spatial separation between screw threaded portion 80 and nut threaded portion 82 (as indicated by the section of position line 112 along the threaded surface) during a non-locked condition is represented by threading free clearance 114. It should first be noted that in addition to this clearance space 114, which is required to enable relative rotation between adjustment nut 68 and connection screw 66 during operative actuation thereof, the basic operating assembly for shutheight adjustment mechanism 50 is also provided with lateral clearance 100 formed between an outer diameter peripheral surface 102 of adjustment nut 68 and an opposing spaced-apart portion of housing assembly or slide attachment piece 96; an upper vertical clearance 104 formed between an upper end surface 106 of adjustment nut 68 and an opposing spaced-apart portion of housing assembly 96; and a lower vertical clearance 108 formed between a lower end surface 110 of adjustment nut 68 and an opposing spaced-apart portion of slide 20. As known to those skilled in the art, these clearances must be present to allow for manufacture, assembly, and operative displacement of the parts in furtherance of the actuation of adjustment mechanism 50. However, the set of clearances 104, 108 and 114 are problematic because they represent vertical increments of distance through which adjustment nut 68 may be axially displaced during certain non-actuating operating conditions such as snap through and high-impact inertial loading. As noted before, the presence of these illustrative clearances 104, 108 and 114 must be reduced and/or eliminated to prevent die penetration problems and adverse changes in the shutheight.

Referring more particularly to FIG. 4 to describe the locking facility of the present invention, the illustrated shutheight adjustment mechanism 50 is adapted to enable a variably controlled deformation activity to be induced, generated, or otherwise developed within adjustment nut 68 in a manner sufficient to cause an inward displacement of nut threaded portion 82 that effectuates as shown a substantial interlocking engagement of adjustment nut 68 and connection screw 66 at their respective threaded portions 82 and 80. Thus, the working clearance 114 between the parts is thereby closed-out. Implementation of this locking facility, in accordance with one form thereof, involves hydraulically pressurizing the fluid chamber formed by lateral clearance space 100 with pressurized fluid provided by variable hydraulic pump assembly 116. This fluid chamber is defined using peripheral seal elements 118 and 120 positioned as shown between nut outer-diameter peripheral surface 102 and housing assembly 96 to seal the fluid chamber subsisting within lateral clearance space 100 from upper vertical clearance 104 and lower vertical clearance 108, respectively, and thereby contain the pressurization within clearance space 100. Pump 116 is arranged as shown for fluid communication with lateral clearance space 100 using fluid line 122, which is illustratively formed in part within housing assembly 96 and has one end that opens into lateral clearance space 100 to establish fluid access therein. The disclosure herein of fluid line 122 being formed in housing assembly 96 should not be considered in limitation of the present invention since any other means may be used to establish hydraulic communication with clearance space 100. A drilled hole (not shown) formed in adjustment nut 68 and extending between clearance space 100 and the threading region may be optionally added to allow high-pressure oil to be forced through the screw and nut threads, with the thread clearance acting as an orifice. This would ensure that lubrication is provided to the threads during a shutheight adjustment mode.

When a locking condition is desired, the fluid chamber at clearance space 100 is sufficiently pressurized by operation of pump assembly 116 such that the pressurized fluid directed against adjustment nut 68 at its outer peripheral surface 102 exerts a compressive influence upon adjustment nut 68 that is effective in displacing adjustment nut 68 from the position indicated by position line 112 (i.e., a non-deformed location) to the illustrated locking position shown in FIG. 4, which is characterized by the interlocking engagement between nut threaded portion 82 and screw threaded portion 80. This manner of compressive-type displacement effectively reduces the inner diameter of adjustment nut 68. This locking arrangement may be sustained by maintaining the pressurization within clearance space 100 at the holding pressure corresponding to the occurrence of the interlocked engagement. Similarly, the locking condition may be reduced or completely removed by appropriately modifying the level of pressurization within clearance space 100 through corresponding control of variable pump assembly 116.

The present invention encompasses the ability to selectively place adjustment nut 68 into one of an actuating condition or a locking condition by constructing and otherwise providing adjustment nut 68 in such a manner that the deformation activity which gives rise to the interlocking engagement is preferably substantially reversible such that adjustment nut 68 may be substantially restored to its original position compatible with shutheight adjustment, i.e., threading clearance 114 reappears to permit actuation of the parts. For this purpose, and without limitation, adjustment nut 68 may include elastic properties, material components, structural features, and other modifications or adaptations that accommodate such reversible deformation. The interlocking engagement would be removed by appropriately reducing the pressurization level within clearance space 100.

In sum, as shown in FIG. 4, the deformation activity affecting adjustment nut 68, which is illustratively provided in the form of a hydraulically-induced radial compression, enables free threading clearance 114 to be closed-out. It should be manifestly apparent that the type of deformation activity illustrated by FIG. 4 appears in a largely exaggerated form and therefore should not be considered in limitation of the present invention but as representative of any form of deformation activity that effectuates the clearance close-outs contemplated by the present invention. In this regard, it should be understood that the present invention facilitates any manner of adjusting the size of the clearances spaces ranging from a complete close-out corresponding to a substantial elimination of the clearance space to a partial close-out corresponding to a reduction in the size of the clearance space. This range of clearance adjustment is made possible by suitably controlling the level of hydraulic pressurization within the fluid chamber formed at clearance space 100.

Figure 5:
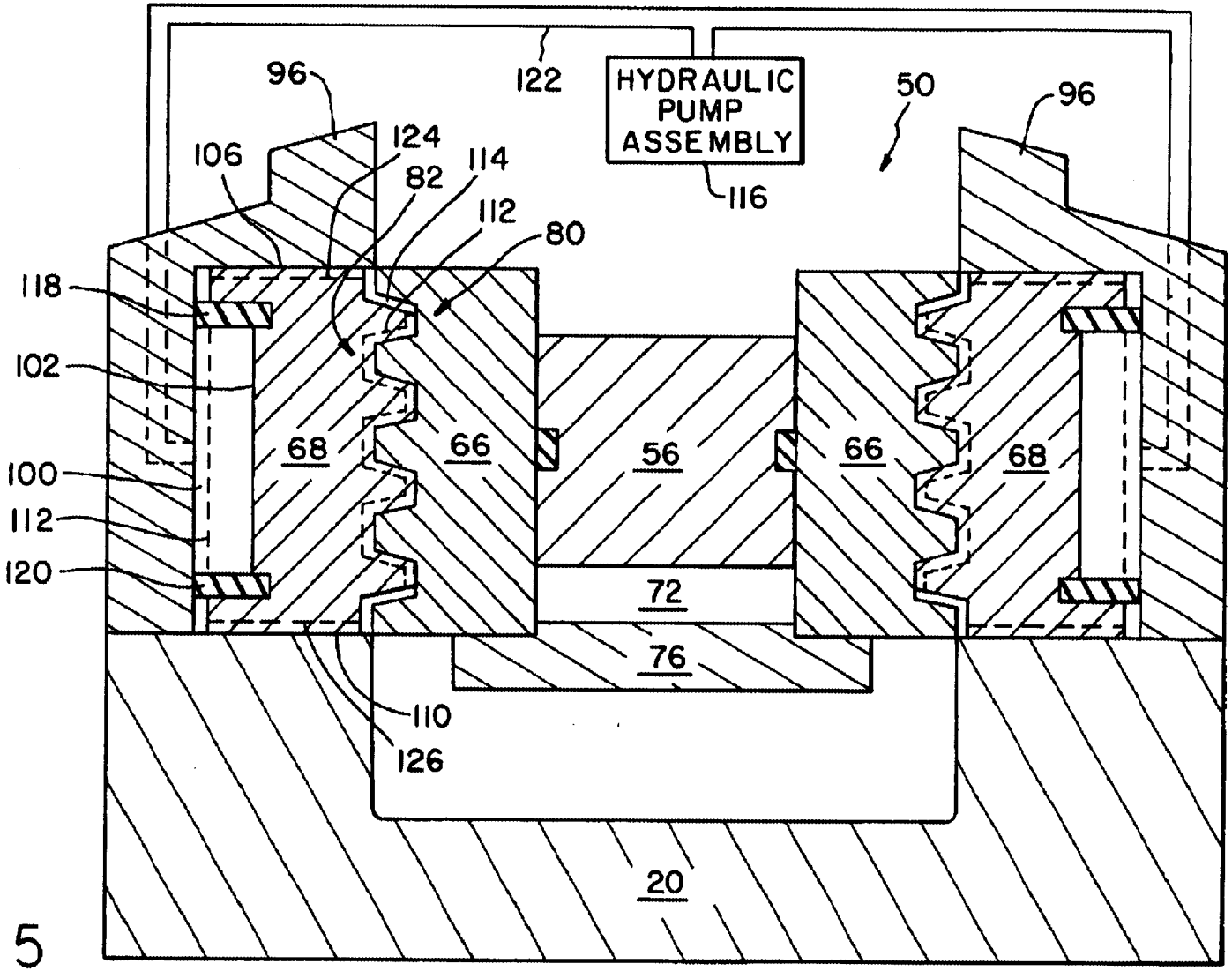
FIG. 5 is a view similar to FIG. 4 additionally illustrating the axial elongation of the nut member which accompanies the compression activity shown in FIG. 4, according to one aspect of the present invention.
Figure 9:
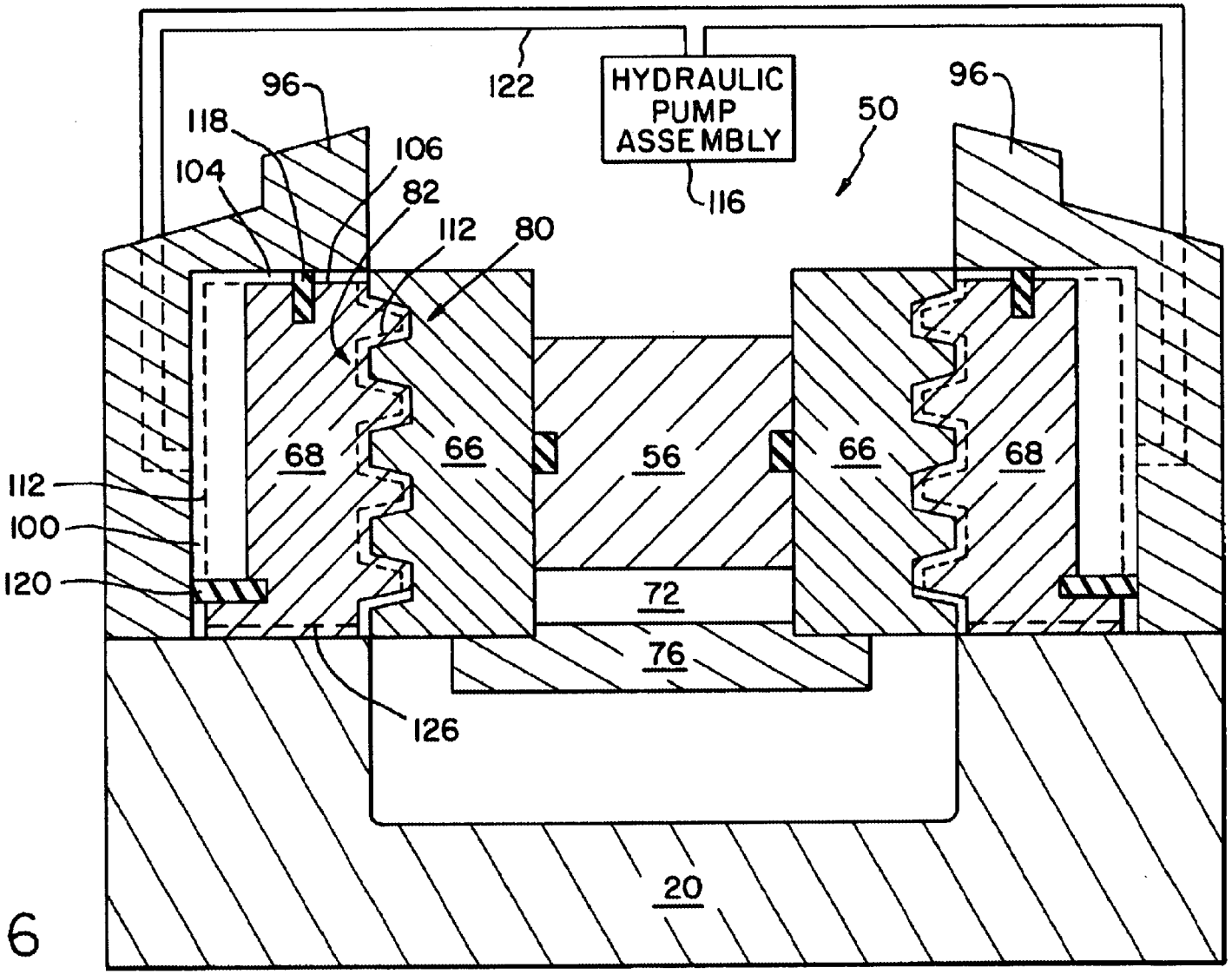
FIG. 9A is an exaggerated fragmentary cross-sectional view of the coupling relationship between the shutheight adjustment mechanism of FIG. 2 and a press machine connection assembly comprising a connecting rod and a wrist pin to illustrate the clearance spaces formed at the pivoting connection between the connecting rod and wrist pin.
FIG. 9B is an exaggerated fragmentary cross-sectional view similar to FIG. 9A with the clearance spaces between the connecting rod and wrist pin being closed-out in accordance with another embodiment of the present invention.
FIG. 9C is an exaggerated fragmentary cross-sectional view similar to FIGS. 9A and 9B with a hollowed wrist pin having end caps in accordance with another embodiment of the present invention.

Referring now to FIG. 5, there is shown a view similar to FIG. 4 for illustrating, in accordance with another aspect of the locking facility of the present invention, the manner in which the compression of adjustment nut 68 depicted by FIG. 4 has the additional effect of eliminating upper vertical clearance 104 and lower vertical clearance 108 due to the presence of a concurrent deformation-type axial displacement of adjustment nut 68. It has been observed that when adjustment nut 68 is appropriately designed and compressed in the manner disclosed by FIG. 4, there occurs an accompanying elongation of adjustment nut 68 along its axial direction that enables adjustment nut 68 at both its upper surface 106 and lower surface 110 to be brought into surface-abutting contacting engagement with opposing portions of housing assembly 96 and slide 20, respectively. The axial elongation or expansion of adjustment nut 68 is preferably conducted in a manner sufficient to close-out the upper and lower vertical clearances 104 and 108 (FIG. 4). Although this close-out of clearances 104 and 108 is made in relation to housing assembly 96 and slide 20, this should not be considered in limitation of the present invention as it should be understood that such axial expansion of adjustment nut 68 can effectively close-out clearances defined with respect to any surrounding part, piece or structure.

This form of deformation activity present along the longitudinal dimension of adjustment nut 68 may be considered to represent a bulging or distending-type effect that is induced by and occurs in response to the compressive pressure being developed within adjustment nut 68. This distending effect may be enhanced by providing adjustment nut 68 with a certain structural profile that promotes such axial expansion in response to pressure building up within adjustment nut 68, such as by constructing adjustment nut 68 to have a concave or inward-formed outer peripheral surface 102 that assists in the upward displacement of adjustment nut 68 as it is being radially compressed. Additionally, in order to enhance bulging of the height of adjustment nut 68, it may be necessary to configure adjustment nut 68 so that the pressure bends it slightly. Increasing the pressurization of the fluid chamber formed at clearance space 100 beyond the level needed to develop interlocking engagement at the threaded portions 80 and 82 may be employed to induce the proper amount of axial deformation for producing the desired close-out of the vertical clearances. The orientation of adjustment nut 68 relative to housing assembly 96 and slide 20 prior to actuation of the locking facility (i.e., implementation of the compression activity), and specifically the position of nut upper surface 106 and nut lower surface 110 before axial displacement (i.e., deformation-type elongation), is indicated respectively by dashed position lines 124 and 126.

Accordingly, as illustrated by FIG. 5, the axial elongation of adjustment nut 68 that develops concurrently with the compression of adjustment nut 68 enables the reduction and/or elimination of vertical clearances at the nut upper and lower surfaces 106 and 110, respectively. Thus, the cumulative deformation activity shown in FIGS. 4 and 5 effectively eliminates both the vertical clearances associated with the threaded portions 80 and 82 of the connection screw 66 and adjustment nut 68 and the vertical clearances associated with the top and bottom areas of adjustment nut 68. As a result, the die penetration problem has been removed from shutheight adjustment mechanism 50 when placed into a locking condition corresponding to an actuation of the locking facility of the present invention illustrated in FIGS. 4 and 5.

As an alternative to effecting a close-out of vertical clearances 104 and 108 by relying upon the deformation-type axial elongation of adjustment nut 68, means may be provided to incrementally displace the appropriate portions of housing assembly 96 and slide 20 in the axial direction to similarly accomplish a close-out of the vertical clearances 104 and 108 formed with adjustment nut 68.

Referring now to FIG. 6, there is shown a view similar to FIG. 4 for illustrating, in accordance with another aspect of the locking facility of the present invention, the manner in which one of the peripheral seals 118 and 120 that assists in defining the pressurized fluid chamber at lateral clearance space 100 may be relocated to an upper or lower axial end of adjustment nut 68 to facilitate close-out of the vertical clearance at the other end. As previously discussed in connection with FIGS. 4 and 5, the fluid chamber pressurized by pump assembly 116 was formed solely within lateral clearance space 100 by virtue of the circumferential positioning of seals 118 and 120 relative to adjustment nut 68. However, by installing seal 118 in the illustrated manner at an upper end of adjustment nut 68, this fluid chamber now extends into and is contiguous with upper vertical clearance 104, at least in part. The purpose of such repositioning of seal 118 is to allow hydraulic pressurization of vertical clearance 104 and thereby generate a sufficient axially-directed pressurizing force acting against adjustment nut 68 at its upper surface 106 that has the effect of displacing the lower surface 110 of adjustment nut 68 into surface-abutting contacting engagement with slide 20. The hydraulic pressurize developed within upper vertical clearance 104 is preferably sufficient to completely close-out the lower vertical clearance 108. The orientation of nut lower surface 110 relative to slide 20 prior to such displacement is indicated by dashed position line 126. Seal 120 may likewise be installed at the lower end of adjustment nut 68 to facilitate a close-out of upper vertical clearance 104. This form of clearance close-out facilitated by the hydraulic pressurization of one of the vertical clearances finds particular use when the axial elongation of adjustment nut 68 illustrated by FIG. 5 is not available or does not occur.

Referring now to FIGS. 7 and 8, there is shown in FIG. 8 a fragmentary section view of another type of shutheight adjustment mechanism 200 depicted in full view by FIG. 7 for describing the manner of accomplishing the illustrated interlocking engagement in a nut-screw combination by expanding the screw member instead of compressing the nut member as previously discussed, in accordance with another embodiment of the present invention. Referring first to FIG. 7, the illustrated shutheight adjustment mechanism 200 includes a quick-access assembly 201 provided in the form of a piston member 202 coupled in a similar manner as piston 56 of FIG. 2 to wrist pin 60 pivotingly supporting connecting rod 64. Mechanism 200 further includes an adjustment assembly 204 comprising a connection screw member 206 and an adjustment nut member 208 having respective threaded portions 210 and 212 provided in intermeshing engagement with a clearance space therebetween (not shown) to allow relative rotation between the parts for changing the shutheight. A drive assembly 214 in the form of a worm gear arrangement is coupled to adjustment nut 208 to drivingly rotate adjustment nut 208 relative to connection screw 206. Connection screw 206 includes an upper end 216 provided in the form of an annular structure defining an inner cylindrical bore 218 within which piston 202 is axially displaceable in response to pressurization changes within a fluid chamber 220 defined between a lower section of screw upper end 216 and an underside of piston 202. Connection screw 206 further includes a lower end 221 provided in the form of a cylindrical body having threaded portion 210 at a peripheral surface thereof. Adjustment nut 208 is provided in the form of an annular structure disposed about connection screw 206 at its lower end 221 such that nut threaded portion 212 is placed in intermeshing engagement with screw threaded portion 210. Adjustment nut 208 is integrally housed within a housing assembly 209 coupled to slide 20. Housing assembly 209 preferably forms part of slide 20. Adjustment assembly 204 is similar to the shutheight adjustment mechanism disclosed in U.S. Pat. No. 5,349,902 assigned to the same assignee as the instant application, which is incorporated herein in its entirety by reference thereto.

Referring more particularly to FIG. 8, the illustrated interlocking engagement between threaded portion 210 of connection screw 206 and threaded portion 212 of adjustment nut 208 is facilitated by adapting the otherwise conventional nut-screw combination to enable a radially outward expansion of connection screw 206 (and hence threaded portion 210), in accordance with the locking facility of the present invention. More specifically, the illustrated shutheight adjustment mechanism 200 is adapted to enable a variably controlled deformation activity to be induced, generated, or otherwise developed within connection screw 206 in a manner sufficient to cause an outward displacement of screw threaded portion 210 that effectuates as shown a substantial interlocking engagement of adjustment nut 208 and connection screw 206 at their respective threaded portions 212 and 210. Thus, the working clearance between the parts is thereby closed-out. Implementation of this locking facility, in accordance with one form thereof, involves suitably providing connection screw 206 with an inner cavity formed at an interior space thereof to define an interior fluid chamber 222 having an inner peripheral sidewall surface 224 preferably having a cylindrical shape. Fluid chamber 222 is placed in hydraulic communication with variable hydraulic pump assembly 226 via fluid line 228, which is illustratively formed in part within slide 20 and opens at one end into fluid chamber 222. The disclosure herein of fluid line 228 being formed in slide 20 should not be considered in limitation of the present invention since any other means may be used to establish hydraulic communication with fluid chamber 222.

When a locking condition is desired, fluid chamber 222 is sufficiently pressurized by operation of pump assembly 226 such that the pressurized fluid directed against connection screw 206 at its interior peripheral surface 224 exerts an expanding influence upon connection screw 206 that is effective in displacing connection screw 206 at its threaded portion 210 from the position indicated by position line 230 (i.e., a non-deformed location) to the illustrated locking position shown in FIG. 8, which is characterized by the interlocking engagement between nut threaded portion 212 and screw threaded portion 210. This manner of expansive-type displacement effectively increases the outer diameter of connection screw 206. This locking arrangement may be sustained by maintaining the pressurization within fluid chamber 222 at the holding pressure corresponding to the occurrence of the interlocked engagement. Similarly, the locking condition may be reduced or completely removed by appropriately modifying the level of pressurization within fluid chamber 222 through corresponding control of variable pump assembly 226.

The present invention encompasses the ability to selectively place connection screw 206 into one of an actuating condition or a locking condition by constructing and otherwise providing connection screw 206 in such a manner that the deformation activity which gives rise to the interlocking engagement is preferably substantially reversible such that connection screw 206 may be substantially restored to its original position compatible with shutheight adjustment, i.e., the working clearance between the parts at their respective threaded portions 210 and 212 reappears to permit actuation of the parts. For this purpose, and without limitation, connection screw 206 may include elastic properties, material components, structural features, and other modifications or adaptations that accommodate such reversible deformation. Referring briefly to FIG. 2, the expandibility of connection screw 66 provided in the form shown for illustrative shutheight adjustment mechanism 50 may be enhanced by modifying end cap structure 76 to incorporate integrally formed threaded portions that permit attachment of end cap structure 76 to connection screw 66 via a threading engagement. The main advantage of this type of attachment is that it obviates any need for securing bolts 78, which otherwise make the portion of connection screw 66 receiving bolts 78 relatively rigid and difficult to uniformly deform. Eliminating the bolted joint in this manner would permit the wall thickness of connection screw 66 to be reduced to thereby enhance its ability to be radially expanded.

In sum, as shown in FIG. 8, the deformation activity affecting connection screw 206, which is preferably provided in the form of a hydraulically-induced radial expansion, enables the free threading clearance between the parts to be closed-out. It should be manifestly apparent that the type of deformation activity illustrated by FIG. 8 appears in a largely exaggerated form and therefore should not be considered in limitation of the present invention but as representative of any form of deformation activity that effectuates the clearance close-outs contemplated by the present invention. In this regard, it should be understood that the present invention facilitates any manner of adjusting the size of the clearances spaces ranging from a complete close-out corresponding to a substantial elimination of the clearance space to a partial close-out corresponding to a reduction in the size of the clearance space. This range of clearance adjustment is made possible by suitably controlling the level of hydraulic pressurization within fluid chamber 222.

The same pump assembly may be used to accomplish both the nut compression activity disclosed in FIGS. 2–6 and the screw expansion activity disclosed in FIGS. 7–8. Moreover, the interlocking engagement between the respective threaded portions of the nut member and screw member may be accomplished by expansion of the screw member, compression of the nut member, or a combination of both, although developing deformation activity within the adjustment nut in the form of a compressive influence is the preferred mode of effectuating the interlocking engagement.

The adjustment nut is preferably deformed because regardless of where it is located with respect to the screw member, it will need only to be deformed an ascertainable constant amount to eliminate the clearances. In contrast, if the screw member is to be deformed, the amount of necessary deformation will greatly depend on the position of the screw member in relation to the adjustment nut.

Figure 9A:
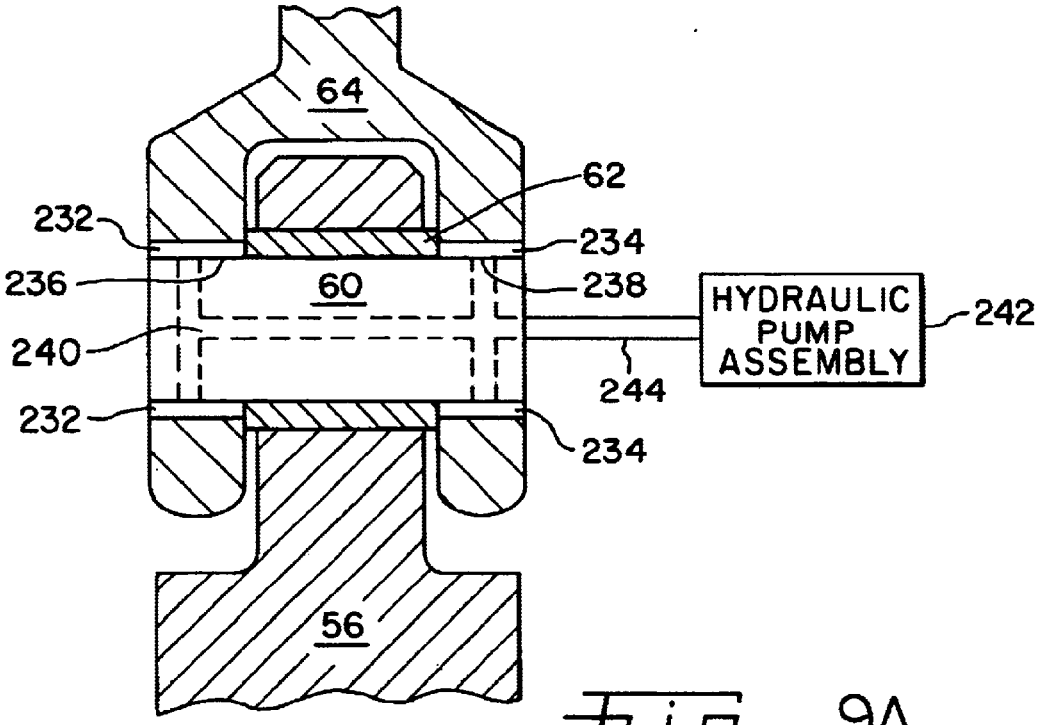
Figure 9B:
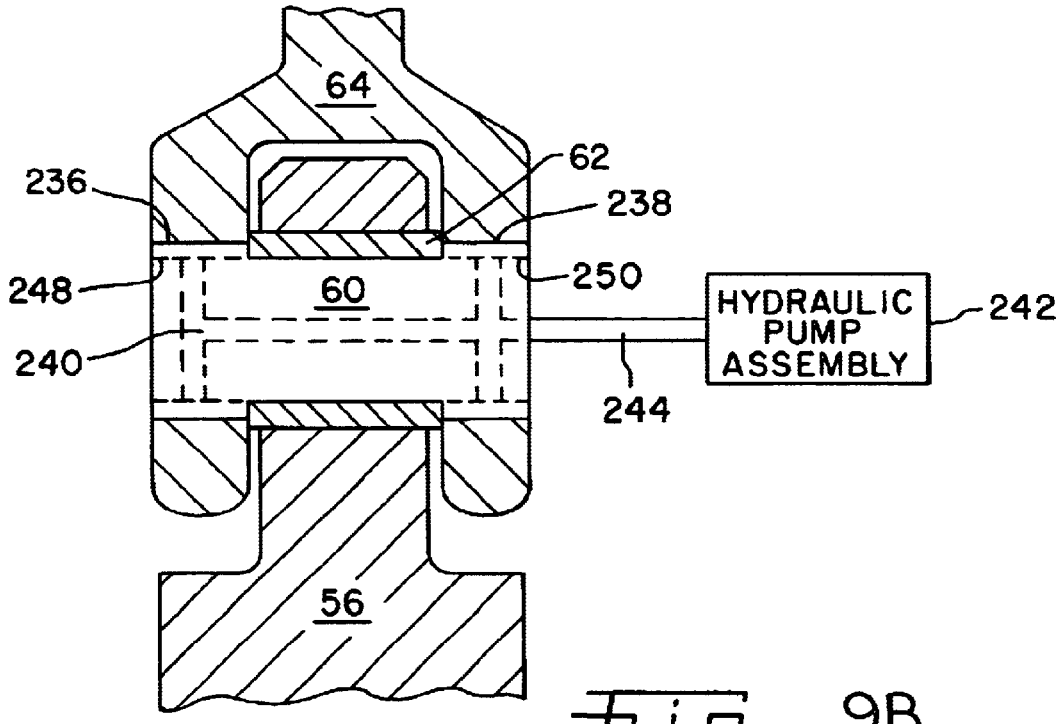

Referring now to FIGS. 9A–B, there is respectively shown in FIGS. 9A and 9B a fragmentary section view of the coupling relationship between shutheight adjustment mechanism 50 of FIG. 2 (i.e., at piston 56) and the connection assembly comprising connecting rod 64 and wrist pin 60 to respectively illustrate the free clearance spaces formed at the pivoting connection therebetween and the close-out of such clearances accomplished in accordance with another embodiment of the present invention. As shown, the pivoting connection between connecting rod 64 and wrist pin 60 includes a set of free clearance spaces 232 and 234 formed annularly about wrist pin 60 and respectively defined between outer circumferential surface portions 236, 238 of wrist pin 60 and opposing surface portions of connecting rod 64. These clearance spaces are conventionally required to permit relative movement between the parts, i.e., a pivoting action. However, as with the vertical clearances discussed previously in regard to the nut-screw arrangement, clearances 232 and 234 provide shutheight adjustment mechanism 50 with the opportunity to be adversely shifted by an amount corresponding to the dimensions of the clearance spaces 232 and 234 since any movement by wrist pin 60 through clearance spaces 232 and 234 will simultaneously move piston 56 of shutheight adjustment mechanism 50 due to their indicated interconnection, resulting in an unwanted change in the shutheight.

Referring more particularly to FIG. 9B, the present invention incorporates a locking facility associated with wrist pin 60 that enables a variably controlled deformation activity to be induced, generated, or otherwise developed within wrist pin 60 in a manner sufficient to cause a radially outward displacement of wrist pin 60 at its outer peripheral surfaces 236 and 238 that effectuates as shown a substantial surface-abutting interference-type contacting engagement between wrist pin 60 (at outer surfaces 236 and 238) and connecting rod 64. Thus, the free working clearances 232 and 234 between the parts is thereby closed-out. Implementation of this locking facility, in accordance with one aspect thereof, involves applying hydraulic pressure against outer peripheral surfaces 236 and 238 in order to facilitate a radial expansion of wrist pin 60 at these outer surfaces. For this purpose, wrist pin 60 is arranged with fluid channels or spaces 240 formed therein, which are disposed in a sufficiently proximal relationship relative to peripheral surfaces 236 and 238 (e.g., immediately subjacent thereto) so as to readily facilitate the radial expansion of wrist pin 60 in response to the hydraulic pressurization of fluid space 240. A hydraulic pump assembly 242 is provided for fluid communication with fluid space 240 using fluid line 244. The illustrated manner of pressurizing fluid space 240 should not be considered in limitation of the present invention as it should be apparent that any means may be used to inject pressurizing fluid within fluid space 240. For example, fluid space 240 may be connected via shutheight adjustment mechanism 50 (e.g., through piston 56) to the fluid chambers formed in association with the nut-screw combination, thereby allowing wrist pin 60 to be pressurized using the same pump assembly as the shutheight adjustment mechanism.

When a locking condition is desired, fluid space 240 is sufficiently pressurized by operation of pump assembly 242 such that the pressurized fluid directed against wrist pin 60 at an interior portion thereof proximate outer peripheral surfaces 236 and 238 exerts an expanding influence upon wrist pin 60 that is effective in displacing wrist pin 60 (i.e., at surfaces 236, 238) from the position indicated by position lines 248 and 250 (i.e., a non-deformed location) to the illustrated locking position shown in FIG. 9B. This manner of expanding-type displacement effectively increases the outer diameter of wrist pin 60 at peripheral surface portions 236 and 238. This locking arrangement may be sustained by maintaining the pressurization within fluid space 240 at the holding pressure corresponding to the occurrence of the locking engagement. Similarly, the locking condition may be reduced or completely removed by appropriately modifying the level of pressurization within fluid space 240 through corresponding control of variable pump assembly 242.

The present invention encompasses the ability to selectively place wrist pin 60 into one of an actuating condition (i.e., pivoting support of connecting rod 64) or a locking condition by constructing and otherwise providing wrist pin 60 in such a manner that the deformation activity which gives rise to the locking engagement is preferably substantially reversible such that wrist pin 60 may be substantially restored to its original position compatible with pivoting support of connecting rod 64. For this purpose, and without limitation, wrist pin 60 may include elastic properties, material components, structural features, and other modifications or adaptations that accommodate such reversible deformation. The locking engagement would be removed by appropriately reducing the pressurization level within fluid space 240.

Figure 9C:
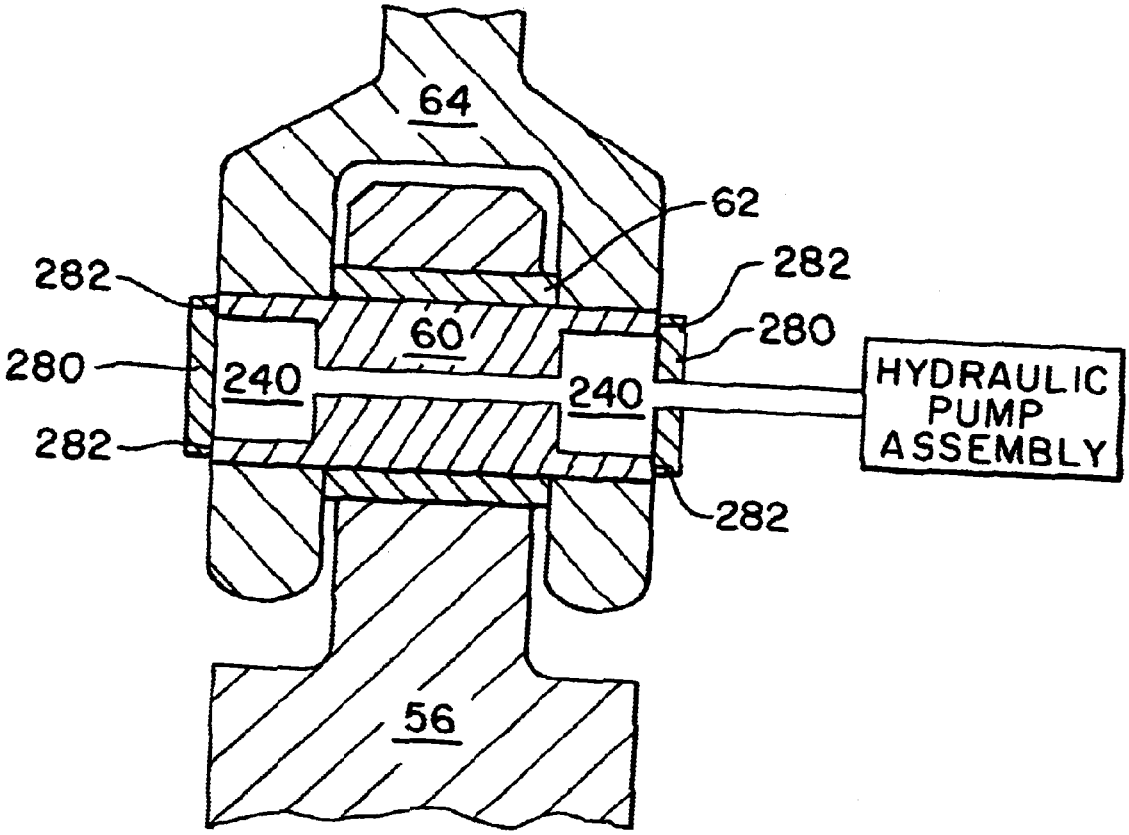

The ability to expand wrist pin 60 may be enhanced by modifying wrist pin 60 to include end cap structures 280, as shown in FIG. 9C, disposed at the axial end surfaces thereof. By including end cap structures 280 along with making wrist pin 60 of a tubular geometry, pressure within wrist pin 60 could be uniformly adjusted within fluid space 240, thereby providing for more uniform expansion of wrist pin 60. End cap structures 280 are attached to wrist pin 60 at fastening locations 282. Fastening locations 282 may be mechanical fastenings (e.g., threaded fasteners such as bolts) and/or metallurgical fastenings (e.g., welds or brazings). Fastening locations 282 may be on the ends of wrist pin 60, as shown in FIG. 9C, or within the ends thereof, end cap structure 280 thereby fitting of wrist pin 60 (i.e., at the perimeter of fluid space 240).

In sum, as shown in FIGS. 9B and 9C, the deformation activity affecting wrist pin 60, which is illustratively provided in the form of a hydraulically-induced radial expansion, enables free working clearances 232 and 234 to be closed-out and, thus, effectively eliminated. Conversely, hydraulic pressure can be reduced to permit assembly/disassembly to occur. It should be manifestly apparent that the type of deformation activity illustrated by FIGS. 9B and 9C appears in a largely exaggerated form and therefore should not be considered in limitation of the present invention but as representative of any form of deformation activity that effectuates the clearance close-outs contemplated by the present invention. In this regard, it should be understood that the present invention facilitates any manner of adjusting the size of the clearances spaces ranging from a complete close-out corresponding to a substantial elimination of the clearance space to a partial close-out corresponding to a reduction in the size of the clearance space. This range of clearance adjustment is made possible by suitably controlling the level of hydraulic pressurization within fluid space 240.

Figure 10:
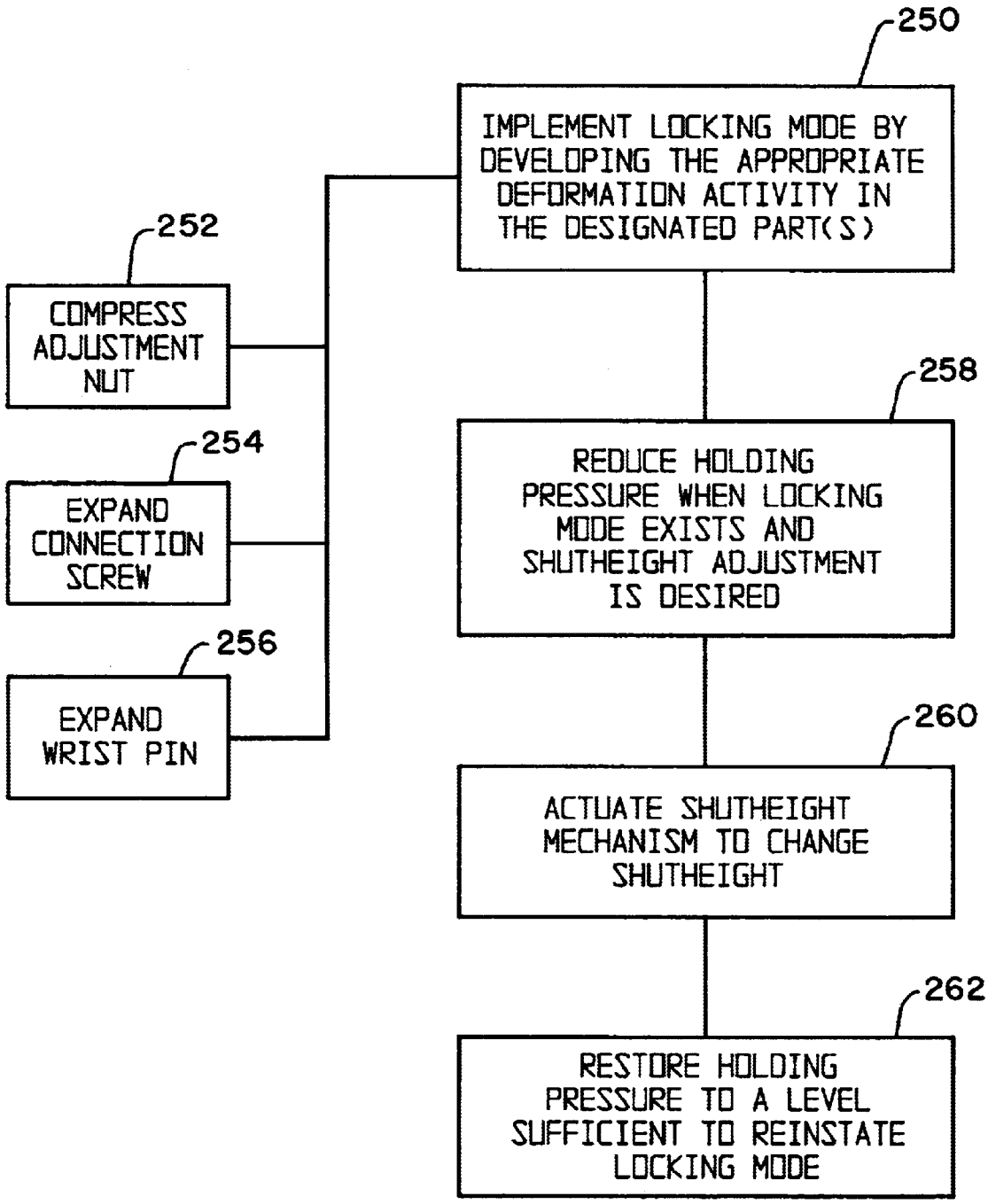
FIG. 10 is a flowchart illustrating the manner of operating a shutheight adjustment mechanism adapted to incorporate a locking capability in accordance with the present invention.

Turning now to the overall operation of the present invention illustratively described by the flowchart of FIG. 10, further reference is made to FIGS. 2–6, FIGS. 7–8, and FIGS. 9A–B, respectively, in regard to compression activity affecting an adjustment nut, expansion activity affecting a connection screw, and expansion activity affecting a wrist pin. For purposes of discussion, it is assumed that references to the compression activity disclosed in FIGS. 2–6 and references to the expansion activity disclosed in FIGS. 7–8 relate to the same shutheight adjustment mechanism. However, it should be apparent that the present invention may be extended to operate in conjunction with a plurality of different shutheight adjustment mechanisms collectively disposed in a press machine, in which the locking facility for each such mechanism may be individually actuated, i.e., selectively operated to variably perform a one of nut compression activity, screw expansion activity, or a combination of both to selectively produce corresponding locking conditions.

During operation, with reference to the operational steps outlined in FIG. 10, the implementation of a locking mode for the nut-screw combination occurs by developing the appropriate deformation activity in at least one of the threaded members by compressing at least in part the female threaded member and/or expanding at least in part the male threaded member to effectuate the interlocking engagement between the respective threaded portions thereof (step 250). This deformation activity preferably takes the form of compressing the female threaded member by directing a pressurized fluid against an outer periphery thereof (step 252), expanding the male threaded member by hydraulically pressurizing an interior space formed therein (step 254), and expanding the wrist pin by hydraulically pressurizing an interior space formed therein (step 256). The inducement of such deformation activity is associated with a holding influence (i.e., hydraulic pressurization level) acting upon the affected part(s) to adjustably continuously maintain the locking engagement between the indicated parts, e.g., adjustment nut and connection screw and/or the wrist pin and connecting rod.

Figure 11:
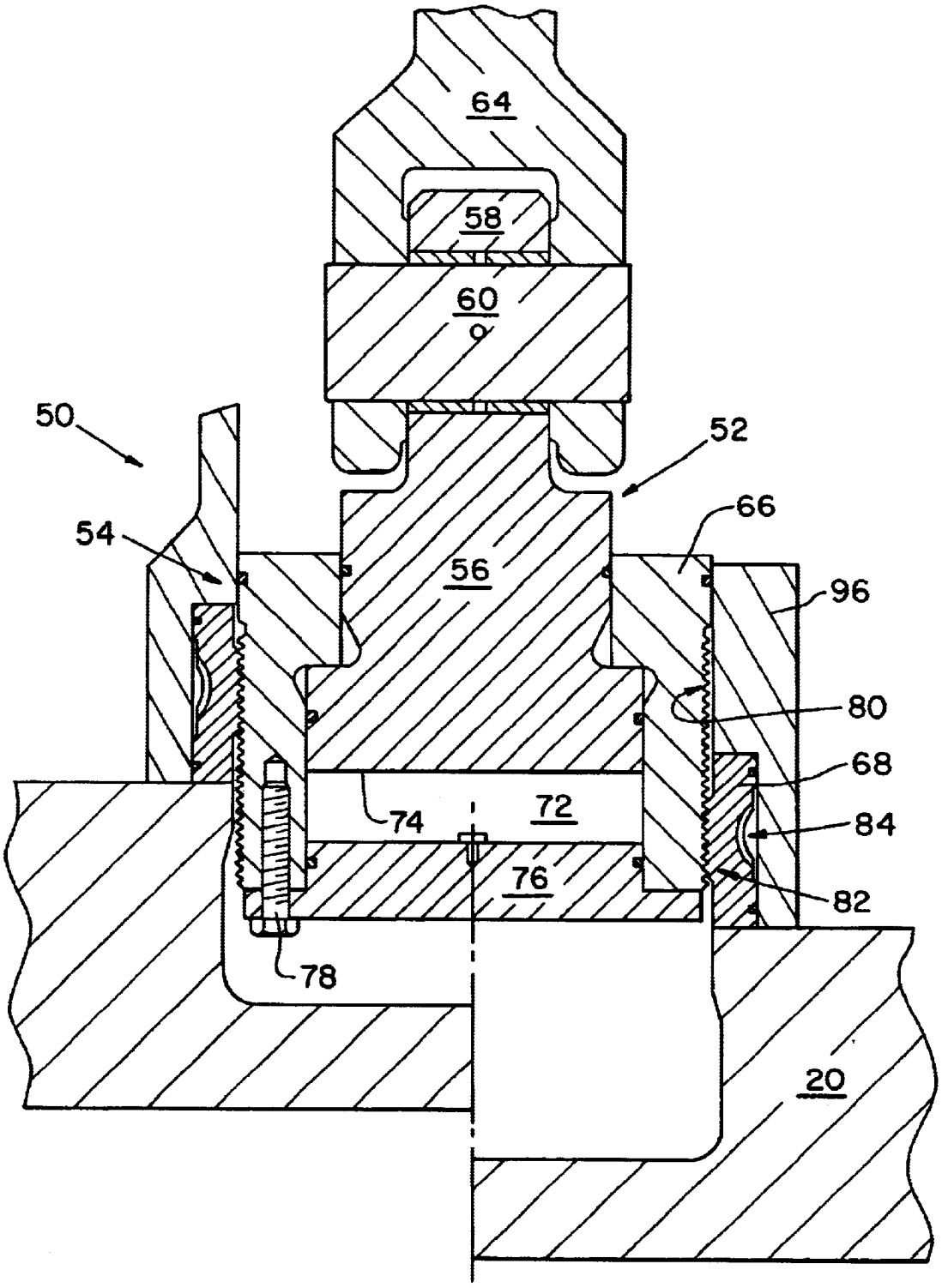
FIG. 11 is a partial cross-sectional view of the shutheight adjustment mechanism shown in FIG. 2 depicting one illustrative form of actuation thereof to change the shutheight.

When an adjustment mode is desired for the shutheight adjustment mechanism and the mechanism is in the locking mode, the holding pressure is first reduced to a level sufficient to accommodate actuation of the parts (step 258). This actuation, for example, corresponds to relative rotation between the male and female threaded members. (In a situation in which adjustment in motion is used it is advantageous to maintain some degree of holding pressure instead of removing all such pressure in order to better preserve the ability to reproduce the bottom-dead-center level by having some amount of opposition to possible die penetration as provided in the form of the partly reduced holding pressure.) The shutheight adjustment mechanism is then actuated to controllably change the shutheight (step 260), which is preferably followed by selective restoration of the reduced holding pressure to a level sufficient to reinstate the locking mode (step 262). FIG. 11 shows one illustrative form of actuation for shutheight adjustment mechanism 50, in which adjustment nut 68 is rotated relative to connection screw 66 by operation of worm drive assembly 84 in order to vertically displace adjustment nut 68 in the illustrated manner to effect a displacement of slide 20, thereby changing the shutheight.

What has been shown and described herein is a locking facility to remove all vertical clearances from the shutheight adjustment mechanism, thereby improving bottom dead center bottom along with a reduction in die penetration. The locking facility permits actuation of the mechanism while the press is operating while continuing to maintain bottom dead center repeatability. In particular, the locking facility of the present invention may be optionally incorporated into shutheight adjustment mechanisms of the type having an adjustment-in-motion (A.I.M.) capability or simply be used as a means to lock the mechanism and eliminate free clearance.

Various modifications and enhancements can be made within the scope of the present invention. For example, although a hydraulic assembly is the preferred apparatus for developing the forces necessary to achieve the nut compression and screw expansion, other means such as a mechanical clamping device or a spacing apparatus may be used to induce the deformation activity. These alternative means may be optionally used to perform the holding operation once the locking condition has been reached by completion of the required hydraulic compression or expansion activity, thereby allowing the hydraulic pressure to be relieved. Although the shutheight adjustment mechanisms disclosed herein were configured within the press slide, this should not be considered in limitation of the present invention as it should be apparent that the present invention may be equivalently incorporated into shutheight adjustment mechanisms installed within the bed or bolster assembly.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A press machine, comprising:

a frame structure with a crown and a bed;

a slide guided by said frame structure for operative reciprocating movement in opposed relation to said bed;

a drive assembly attached to said frame structure for operatively reciprocating said slide;

a bolster assembly mounted to said bed;

a shutheight adjustment mechanism configured within said press machine and arranged to controllably adjust the press shutheight between said slide and said bed;

said shutheight adjustment mechanism comprising a male threaded member threadedly engaging a female threaded member, wherein at least one of said threaded members being rotatable relative to the other of said threaded members to change the press shutheight, said shutheight adjustment mechanism operatively including at least one clearance space defined between respective threaded portions of said male threaded member and said female threaded member; and means for inducing a deformation activity in at least one of said male threaded member and said female threaded member sufficient to effectuate a substantial interlocking engagement between, at least in part, the respective threaded portions of said male threaded member and said female threaded member, wherein said deformation inducement means includes a hydraulic assembly arranged to compress said female threaded member by applying pressurized fluid along a periphery thereof and/or expand said male threaded member by hydraulically pressurizing an interior space thereof.

2. The press machine as recited in claim 1, wherein said male threaded member includes a screw and said female threaded member includes an adjustment nut disposed, at least in part, about said screw.

3. The press machine as recited in claim 1, wherein the interlocking engagement between said male threaded member and said female threaded member being characterized by a substantial elimination of a clearance space associated with respective threaded portions of said male threaded member and said female threaded member disposed in interlocking engagement.

4. The press machine as recited in claim 1, wherein said hydraulic assembly is arranged to direct pressurized fluid against an outer periphery of said female threaded member to generate deformation activity therein sufficient to bring said respective threaded portion thereof into interlocking engagement with said male threaded member at the respective threaded portion thereof.

5. The press machine as recited in claim 4, wherein the deformation activity generated in said female threaded member being sufficient further to induce an accompanying elongation of said female threaded member along an axial dimension thereof which is sufficient to substantially close out at least one clearance space defined adjacent a respective axial end surface of said female threaded member.

6. The press machine as recited in claim 4, wherein said hydraulic assembly being arranged further to selectively direct pressurized fluid against one axial end surface of said female threaded member to effectively displace another axial end surface of said female threaded member in a manner sufficient to substantially close out a clearance space defined adjacent said another axial end surface.

7. The press machine as recited in claim 1, wherein said hydraulic assembly is arranged to hydraulically pressurize said interior space of said male threaded member to generate deformation activity therein which is sufficient to bring said respective threaded portion thereof into interlocking engagement with said female threaded member at the respective threaded portion thereof.

8. The press machine as recited in claim 1, wherein said shutheight adjustment mechanism is attached to a one of said slide and said bolster assembly.

9. The press machine as recited in claim 1, wherein said shutheight adjustment mechanism being arranged further to enable an adjustment-in-motion operability.

10. The press machine as recited in claim 1, wherein said drive assembly further comprises:

a crankshaft;

a plurality of connection assemblies each arranged to couple said crankshaft to said slide, each one of said plurality of connection assemblies respectively including a wrist pin and an associated connecting rod pivotingly connected to said wrist pin and defining therewith at least one clearance space therebetween; and second means for inducing a deformation activity in at least one of said plurality of wrist pins which is sufficient to displace an outer periphery of said at least one wrist pin to substantially close out at least one of the at least one clearance space associated therewith.

11. The press machine as recited in claim 10, wherein said second means for inducing a deformation activity comprises:

a hydraulic assembly arranged to hydraulically pressurize an interior space of said at least one wrist pin to effectuate the respective deformation activity therein.

12. A press machine, comprising:

a frame structure with a crown and a bed;

a slide guided by said frame structure for operative reciprocating movement in opposed relation to said bed;

a drive assembly attached to said frame structure for operatively reciprocating said slide;

a bolster assembly mounted to said bed;

a shutheight adjustment mechanism configured within said press machine and arranged to controllably adjust the press shutheight between said slide and said bed;

said shutheight adjustment mechanism comprising a male threaded member threadedly engaging a female threaded member, wherein at least one of said threaded members being rotatable relative to the other of said threaded members to change the press shutheight, said shutheight adjustment mechanism operatively including at least one clearance space defined between respective threaded portions of said male threaded member and said female threaded member; and a hydraulic assembly arranged to operatively perform at least one of compressing at least in part said female threaded member by applying pressurized fluid along a periphery thereof in a manner sufficient to bring said respective threaded portion thereof into interlocking engagement with said male threaded member at the respective threaded portion thereof and expanding at least in part said male threaded member by hydraulically pressurizing an interior space thereof by supplying a pressurized fluid directly therewithin in a manner sufficient to bring said respective threaded portion thereof into interlocking engagement with said female threaded member at the respective threaded portion thereof.

13. The press machine as recited in claim 12, wherein the compression of said female threaded member is associated with the presence of reversible deformation activity occurring therein and wherein the expansion of said male threaded member is associated with the presence of reversible deformation activity occurring therein.

14. The press machine as recited in claim 12, wherein said male threaded member includes a screw and said female threaded member includes an adjustment nut disposed, at least in part, about said screw.

15. The press machine as recited in claim 12, wherein the interlocking engagement between said male threaded member and said female threaded member being characterized by a substantial elimination of a clearance space associated with respective threaded portions of said male threaded member and said female threaded member disposed in interlocking engagement.

16. The press machine as recited in claim 12, wherein the deformation activity generated in said female threaded member being sufficient further to induce an accompanying elongation of said female threaded member along an axial dimension thereof which is sufficient to substantially close out at least one axial clearance space defined adjacent a respective axial end surface of said female threaded member.

17. The press machine as recited in claim 12, wherein said hydraulic assembly being arranged further to selectively direct pressurized fluid against one axial end surface of said female threaded member to effectively displace another axial end surface of said female threaded member in a manner sufficient to substantially close out an axial clearance space defined adjacent said another axial end surface.

18. The press machine as recited in claim 12, wherein said shutheight adjustment mechanism being arranged further to enable an adjustment-in-motion operability.

19. The press machine as recited in claim 12, wherein said shutheight adjustment mechanism is attached to a one of said slide and said bolster assembly.

20. A press machine, comprising:

a frame structure with a crown and a bed;

a slide guided by said frame structure for operative reciprocating movement in opposed relation to said bed;

a drive assembly attached to said frame structure for operatively reciprocating said slide;

a bolster assembly mounted to said bed;

a shutheight adjustment mechanism configured within said press machine and arranged to controllably adjust the press shutheight between said slide and said bed;

said shutheight adjustment mechanism comprising a male threaded member threadedly engaging a female threaded member, wherein at least one of said threaded members being rotatable relative to the other of said threaded members to change the press shutheight, said shutheight adjustment mechanism operatively including at least one clearance space defined between respective threaded portions of said male threaded member and said female threaded member; and an actuating assembly operatively associated with said shutheight adjustment mechanism and being arranged to effectuate a substantial interlocking engagement between, at least in part, the respective threaded portions of said male threaded member and said female threaded member by compressing at least in part said female threaded member and/or expanding at least in part said male threaded member, wherein said actuating assembly includes a hydraulic assembly being arranged to apply a pressurized fluid along a periphery of said female threaded member to exert a compressive influence thereon and/or to apply a pressurized fluid directly within an interior space formed in said male threaded member to exert an expansive influence thereon.

21. The press machine as recited in claim 20, wherein said male threaded member includes a screw and said female threaded member includes an adjustment nut disposed, at least in part, about said screw.

22. The press machine as recited in claim 20, wherein the interlocking engagement between said male threaded member and said female threaded member being characterized by a substantial elimination of a clearance space associated with respective threaded portions of said male threaded member and said female threaded member disposed in interlocking engagement.

23. The press machine as recited in claim 20, wherein the compression of said female threaded member being sufficient to induce an accompanying elongation of said female threaded member along an axial dimension thereof which is sufficient to substantially close out at least one clearance space defined adjacent a respective axial end surface of said female threaded member.

24. The press machine as recited in claim 20, wherein said shutheight adjustment mechanism is attached to a one of said slide and said bolster assembly.

25. A method of adjusting the shutheight in a press machine, said press machine comprising a frame structure with a crown and a bed, a slide guided by said frame structure for operative reciprocating movement in opposed relation to said bed, a drive assembly attached to said frame structure for operatively reciprocating said slide, and a bolster assembly mounted to said bed, said method comprising the steps of:

providing a shutheight adjustment mechanism configured within said press machine and arranged to controllably adjust the press shutheight between said slide and said bed, said shutheight adjustment mechanism comprising a male threaded member threadedly engaging a female threaded member, wherein at least one of said threaded members being rotatable relative to the other of said threaded members to change the press shutheight, said shutheight adjustment mechanism operatively including at least one clearance space defined between respective threaded portions of said male threaded member and said female threaded member;

when a locking mode is desired for said shutheight adjustment mechanism, inducing a deformation activity in at least one of said male threaded member and said female threaded member sufficient to effectuate a substantial interlocking engagement between, at least in part, the respective threaded portions of said male threaded member and said female threaded member, the step of inducing a deformation activity in at least one of said male threaded member and said female threaded member comprising at least one of the steps of directing pressurized fluid against an outer periphery of said female threaded member to generate deformation activity therein and hydraulically pressurizing an interior space of said male threaded member by supplying a pressurized fluid directly within said interior space to generate deformation activity in said male threaded member, wherein the inducement of said deformation activity is associated with a holding influence acting upon the at least one of said male threaded member and said female threaded member to adjustably continuously maintain said interlocking engagement;

when an adjustment mode is desired for said shutheight adjustment mechanism and said shutheight adjustment mechanism is in said locking mode, performing the steps of reducing the holding influence to a level sufficient to accommodate operative rotational activity between said male threaded member and said female threaded member, actuating said shutheight adjustment mechanism to controllably change the shutheight, and then selectively restoring said holding influence to a level sufficient to effectuate said locking mode; and when an adjustment mode is desired for said shutheight adjustment mechanism and said shutheight adjustment mechanism is not in said locking mode, actuating said shutheight adjustment mechanism to controllably change the shutheight.

26. The method as recited in claim 25, wherein the step of inducing a deformation activity in at least one of said male threaded member and said female threaded member comprises the steps of:

directing said pressurized fluid against said outer periphery of said female threaded member to generate said deformation activity therein; and hydraulically pressurizing said interior space of said male threaded member to generate said deformation activity therein.

27. The method as recited in claim 26, wherein the step of reducing said holding influence further comprises the steps of:

reducing the pressurization level of fluid directed against the outer periphery of said female threaded member; and reducing the hydraulic pressurization level within the interior space of said male threaded member.

28. The method as recited in claim 25, wherein the interlocking engagement between said male threaded member and said female threaded member being characterized by a substantial elimination of a clearance space associated with respective threaded portions of said male threaded member and said female threaded member disposed in interlocking engagement.

29. The method as recited in claim 25, wherein said male threaded member includes a screw and said female threaded member includes an adjustment nut disposed, at least in part, about said screw.

30. The method as recited in claim 25, wherein said shutheight adjustment mechanism is attached to a one of said slide and said bolster assembly.

31. A method of adjusting the shutheight in a press machine, said press machine comprising a frame structure with a crown and a bed, a slide guided by said frame structure for operative reciprocating movement in opposed relation to said bed, a drive assembly attached to said frame structure for operatively reciprocating said slide, and a bolster assembly mounted to said bed, said method comprising the steps of:

providing a shutheight adjustment mechanism configured within said press machine and arranged to controllably adjust the press shutheight between said slide and said bed, said shutheight adjustment mechanism comprising a male threaded member threadedly engaging a female threaded member, wherein at least one of said threaded members being rotatable relative to the other of said threaded members to change the press shutheight, said shutheight adjustment mechanism operatively including at least one clearance space defined between respective threaded portions of said male threaded member and said female threaded member;

when a locking mode is desired for said shutheight adjustment mechanism, effectuating a substantial interlocking engagement between, at least in part, the respective threaded portions of said male threaded member and said female threaded member by compressing at least in part said female threaded member and/or expanding at least in part said male threaded member, the compression of said female threaded member including directing a pressurized fluid against an outer periphery thereof, the expansion of said male threaded member including hydraulically pressurizing an interior space formed therein by supplying a pressurized fluid within said interior space;

when an adjustment mode is desired for said shutheight adjustment mechanism and said shutheight adjustment mechanism is in said locking mode, performing the steps of reducing at least one of the compression of said female threaded member and the expansion of said male threaded member to a level sufficient to accommodate actuation of said shutheight adjustment mechanism, actuating said shutheight adjustment mechanism to controllably change the shutheight, and then selectively restoring at least one of the compression of said female threaded member and the expansion of said male threaded member to a level sufficient to effectuate said locking mode; and when an adjustment mode is desired for said shutheight adjustment mechanism and said shutheight adjustment mechanism is not in said locking mode, actuating said shutheight adjustment mechanism to controllably change the shutheight.

32. The method as recited in claim 31, wherein the interlocking engagement between said male threaded member and said female threaded member being characterized by a substantial elimination of a clearance space associated with respective threaded portions of said male threaded member and said female threaded member disposed in interlocking engagement.

33. The method as recited in claim 31, wherein said male threaded member includes a screw and said female threaded member includes an adjustment nut disposed, at least in part, about said screw.

34. The method as recited in claim 31, wherein said shutheight adjustment mechanism is attached to a one of said slide and said bolster assembly.

* * * * *